US007131915B2

(12) United States Patent
Sullivan et al.

(10) Patent No.: US 7,131,915 B2
(45) Date of Patent: Nov. 7, 2006

(54) THREE-LAYER-COVER GOLF BALL

(75) Inventors: Michael J. Sullivan, Barrington, RI (US); Derek A. Ladd, Acushnet, MA (US); Antonio U. DeSimas, East Providence, RI (US)

(73) Assignee: Acushnet Company, Fairhaven, MA (US)

( * ) Notice: Subject to any disclaimer, the term of this patent is extended or adjusted under 35 U.S.C. 154(b) by 4 days.

(21) Appl. No.: 10/877,344

(22) Filed: Jun. 25, 2004

(65) Prior Publication Data

US 2004/0235587 A1 Nov. 25, 2004

Related U.S. Application Data

(63) Continuation-in-part of application No. 10/160,827, filed on May 30, 2002, now abandoned, which is a continuation of application No. 09/853,252, filed on Apr. 10, 2001, now Pat. No. 6,685,579.

(51) Int. Cl.
*A63B 37/04* (2006.01)
*A63B 37/06* (2006.01)

(52) U.S. Cl. ..... 473/376; 473/378

(58) Field of Classification Search ..... 473/351–377
See application file for complete search history.

(56) References Cited

U.S. PATENT DOCUMENTS

| | | | | |
|---|---|---|---|---|
| 5,306,760 | A | 4/1994 | Sullivan | 524/400 |
| 5,334,673 | A * | 8/1994 | Wu | 473/378 |
| 5,688,191 | A | 11/1997 | Cavallaro et al. | 473/373 |
| 5,759,676 | A | 6/1998 | Cavallaro et al. | 428/215 |
| 5,810,678 | A | 9/1998 | Cavallaro et al. | 473/373 |
| 5,813,923 | A | 9/1998 | Cavallaro et al. | 473/373 |
| 5,816,937 | A | 10/1998 | Shimosaka et al. | 473/354 |
| 5,830,087 | A * | 11/1998 | Sullivan et al. | 473/385 |
| 5,873,796 | A | 2/1999 | Cavallaro et al. | 473/365 |
| 5,902,855 | A | 5/1999 | Sullivan | 525/221 |
| 5,919,100 | A | 7/1999 | Boehm et al. | 473/354 |
| 5,919,862 | A | 7/1999 | Rajagopalan | 525/63 |
| 5,947,842 | A | 9/1999 | Cavallaro et al. | 473/373 |
| 5,965,669 | A | 10/1999 | Cavallaro et al. | 525/221 |
| 5,967,908 | A | 10/1999 | Yamagishi et al. | 473/373 |
| 5,971,870 | A * | 10/1999 | Sullivan et al. | 473/373 |
| 5,981,654 | A | 11/1999 | Rajagopalan | 525/66 |
| 6,001,930 | A | 12/1999 | Rajagopalan | 525/92 |
| 6,068,561 | A | 5/2000 | Renard et al. | 473/364 |
| 6,095,932 | A | 8/2000 | Umezawa et al. | 473/356 |
| 6,117,025 | A | 9/2000 | Sullivan | 473/373 |
| 6,120,392 | A | 9/2000 | Kashiwagi et al. | 473/374 |
| 6,124,389 | A | 9/2000 | Cavallaro et al. | 524/432 |
| 6,126,558 | A | 10/2000 | Higuchi et al. | 473/374 |
| 6,129,640 | A | 10/2000 | Higuchi et al. | 473/374 |
| 6,152,834 | A | 11/2000 | Sullivan | 473/365 |
| 6,187,864 | B1 | 2/2001 | Rajagopalan | 525/183 |
| 6,245,862 | B1 | 6/2001 | Rajagopalan | 525/340 |

(Continued)

FOREIGN PATENT DOCUMENTS

| | | |
|---|---|---|
| WO | WO 00/23519 | 4/2000 |

(Continued)

*Primary Examiner*—Eugene Kim
*Assistant Examiner*—Alvin A. Hunter, Jr.
(74) *Attorney, Agent, or Firm*—William B. Lacy

(57) ABSTRACT

A golf ball comprising a core; and a cover comprising an inner cover layer; an outer cover layer having a material hardness of 60 Shore D or less; and an intermediate cover layer disposed between the inner and outer cover layers; wherein at least two of the inner, intermediate, and outer cover layers comprise a non-ionomeric material.

20 Claims, 1 Drawing Sheet

U.S. PATENT DOCUMENTS

| | | | | |
|---|---|---|---|---|
| 6,274,669 | B1 | 8/2001 | Rajagopalan | 525/64 |
| 6,290,614 | B1 * | 9/2001 | Kennedy, et al. | 473/378 |
| 6,353,058 | B1 | 3/2002 | Rajagopalan | 525/179 |
| 6,511,388 | B1 * | 1/2003 | Dewanjee | 473/377 |
| 6,548,618 | B1 * | 4/2003 | Sullivan et al. | 528/76 |
| 6,607,686 | B1 * | 8/2003 | Dewanjee | 264/279.1 |
| 6,653,382 | B1 * | 11/2003 | Statz et al. | 524/400 |
| 6,685,579 | B1 | 2/2004 | Sullivan | 473/357 |
| 6,685,580 | B1 | 2/2004 | Sullivan | 473/374 |
| 6,849,006 | B1 * | 2/2005 | Cavallaro et al. | 473/376 |
| 6,855,073 | B1 * | 2/2005 | Keller et al. | 473/374 |
| 6,905,648 | B1 * | 6/2005 | Sullivan et al. | 264/279.1 |
| 2002/0151381 | A1 | 10/2002 | Sullivan | 473/354 |
| 2003/0125480 | A1 | 7/2003 | Sullivan et al. | 525/418 |
| 2004/0010096 | A1 | 1/2004 | Rajagopalan et al. | 525/453 |

FOREIGN PATENT DOCUMENTS

| | | |
|---|---|---|
| WO | WO 00/57961 | 10/2000 |
| WO | WO 01/29129 | 4/2001 |
| WO | WO 2004108817 A1 * | 12/2004 |

* cited by examiner

THREE-LAYER-COVER GOLF BALL

CROSS REFERENCE TO RELATED APPLICATIONS

This application is a continuation-in-part of U.S. patent application Ser. No. 10/160,827, filed May 30, 2002 now abandoned, which is a continuation of U.S. patent application Ser. No. 09/853,252, filed Apr. 10, 2001, now U.S. Pat. No. 6,685,579. The '827 application and the '579 patent are incorporated by reference in their entireties.

FIELD OF THE INVENTION

This invention relates generally to golf balls, and more specifically, to a golf ball having a cover comprising an outer cover layer, an intermediate cover layer, and an inner cover layer, at least one of which includes a non-ionomeric composition.

BACKGROUND OF THE INVENTION

The majority of golf balls commercially available today can be grouped into two general classes: solid and wound. Solid golf balls include one-piece, two-piece, and multi-layer golf balls. One-piece golf balls are inexpensive and easy to construct, but have limited playing characteristics and their use is usually confined to the driving range. Two-piece balls are generally constructed with a polybutadiene solid core and a cover and are typically the most popular with recreational golfers because they are very durable and provide good distance. These balls are also relatively inexpensive and easy to manufacture, but are regarded by top players as having limited playing characteristics. Multi-layer golf balls are comprised of a solid core and a cover, either of which may be formed of one or more layers. These balls are regarded as having an extended range of playing characteristics, but are more expensive and difficult to manufacture than the one- and two-piece golf balls.

Wound golf balls, which typically include a fluid-filled center surrounded by tensioned elastomeric material and a cover, are preferred by many players due to their spin and "feel" characteristics but are more difficult and expensive to manufacture than are most solid golf balls. Manufacturers are constantly striving, therefore, to produce a solid ball that retains the beneficial characteristics of a solid ball while concurrently exhibiting the beneficial characteristics of a wound ball.

Golf ball playing characteristics, such as compression, velocity, feel, and spin, can be adjusted and optimized by manufacturers to suit players having a wide variety of playing abilities. For example, manufacturers can alter any or all of these properties by changing the polymer compositions and/or the physical construction of each or all of the various golf ball components, i.e., centers, cores, intermediate layers, and covers. Finding the right combination of core and layer materials and the ideal ball construction to produce a golf ball suited for a predetermined set of performance criteria is a challenging task.

In their efforts to construct multi-layer golf balls that have the benefits of both solid and wound balls, manufacturers have been focusing on the use of ionomeric compositions for the cover layers. However, it can be difficult to provide good "feel" characteristics in a golf ball with the use of ionomers, which tend to provide a "plastic feel."

Therefore, there is a need to construct golf balls using non-ionmeric materials for at least two of the three cover layers.

SUMMARY OF THE INVENTION

The invention is directed to a golf ball including a core and a cover. The cover includes an inner cover layer; an outer cover layer having a material hardness of 60 Shore D or less; and an intermediate cover layer disposed between the inner and outer cover layers. At least two of the inner, intermediate, and outer cover layers includes a non-ionomeric material.

The outer cover layer preferably has a thickness of 0.005 inches or greater, more preferably 0.005 inches to 0.030 inches, and typically includes a polyurethane, a polyurea, a copolymer of a polyurethane, a copolymer of a polyurea, or an interpenetrating polymer network.

The polyurethane, the polyurea, the copolymer of the polyurethane, and the copolymer of the polyurea are prepared from an isocyanate, such as 2,2'-, 2,4'-, and 4,4'-diphenylmethane diisocyanate, 3,3'-dimethyl-4,4'-biphenyl diisocyanate, toluene diisocyanate, polymeric diphenylmethane diisocyanates, carbodimide-modified liquid 4,4'-diphenylmethane diisocyanate, p-phenylene diisocyanate, m-phenylene diisocyanate, triphenylmethane-4,4'-triisocyanate, and triphenylmethane-4,4"-triisocyanate, napthylene-1,5,-diisocyanate, 2,4'-, 4,4'-, and 2,2-biphenyl diisocyanate, polyphenyl polymethylene polyisocyanate, ethylene diisocyanate, propylene-1,2-diisocyanate, tetramethylene diisocyanate, tetramethylene-1,4-diisocyanate, 1,6-hexamethylene-diisocyanate, octamethylene diisocyanate, decamethylene diisocyanate, 2,2,4-trimethylhexamethylene diisocyanate, 2,4,4-trimethylhexamethylene diisocyanate, dodecane-1,12-diisocyanate, cyclobutane-1,3-diisocyanate, cyclohexane-1,2-diisocyanate, cyclohexane-1,3-diisocyanate, cyclohexane-1,4-diisocyanate, methyl-cyclohexylene diisocyanate, 2,4-methylcyclohexane diisocyanate, 2,6-methylcyclohexane diisocyanate, 4,4'-dicyclohexyl diisocyanate, 2,4'-dicyclohexyl diisocyanate, 1,3,5-cyclohexane triisocyanate, isocyanatomethylcyclohexane isocyanate, 1-isocyanato-3,3,5-trimethyl-5-isocyanatomethylcyclohexane, isocyanatoethylcyclohexane isocyanate, bis(isocyanatomethyl)cyclohexane diisocyanate, 4,4'-bis(isocyanatomethyl) dicyclohexane, 2,4'-bis(isocyanatomethyl) dicyclohexane, isophorone diisocyanate, triisocyanate of hexamethylene-diisocyanate, triisocyanate of 2,2,4-trimethyl-1,6-hexane diisocyanate, 4,4'-dicyclohexylmethane diisocyanate, 2,4-hexahydrotoluene diisocyanate, 2,6-hexahydrotoluene diisocyanate, 1,2-, 1,3-, and 1,4-xylene diisocyanate, m-tetramethylxylene diisocyanate, p-tetramethylxylene diisocyanate, trimerized isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, dimerized uretdione of toluene diisocyanate, or uretdione of hexamethylene diisocyanate.

The polyurethane and the copolymer of the polyurethane are generally prepared from a polyol, such as polytetramethylene ether glycol, copolymer of polytetramethylene ether glycol and 2-methyl-1,4-butane diol, poly(oxyethylene) glycol, poly(oxypropylene) glycol, poly(oxyethylene oxypropylene) glycol, ethylene oxide capped poly(oxypropylene) glycol, o-phthalate-1,6-hexanediol, polyethylene adipate glycol, polyethylene propylene adipate glycol, polyethylene butylene adipate glycol, polybutylene adipate glycol, polyhexamethylene adipate glycol, polyhexamethylene butylene adipate glycol, polyethylene terephthalate polyester polyol, ethylene glycol initiated polycaprolactone, diethylene glycol initiated polycaprolactone, propylene glycol initiated polycaprolactone, dipropylene glycol initiated polycaprolactone, trimethylol propane initiated polycaprolactone, neopentyl glycol initiated polycaprolactone, 1,4-butanediol-initiated polycaprolactone, 1,6-hexanediol-initiated polycaprolactone, polytetramethylene ether glycol initiated polycaprolactone, poly(phthalate carbonate) glycol, poly(hexamethylene carbonate) glycol, polycarbonate polyols containing bisphenol A, and mixture thereof.

The polyurea and the copolymer of the polyurea are typically prepared from a polyamine, such as 3,5-dimethylthio-2,4-toluenediamine; 3,5-diethyltoluene-2,4-diamine, 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; or a mixture thereof.

The intermediate cover layer of the golf ball has a thickness of 0.005 to 0.050 inches, more preferably 0.010 to 0.020 inches, and typically includes a polyurethane, a polyurea, a polyurethane ionomer, an ionomer, a polyamide, a non-ionomeric polyolefin, a metallocene-catalyzed polymer, a polycarbonate, a styrene-butadiene block copolymer, a polyamide ester, a polyamide, and a polyester.

Preferably, at least one of the inner or intermediate cover layers includes a non-ionomeric composition formed from an acid copolymer or terpolymer having a formula of E/X/Y, wherein E is an olefin, Y is a carboxylic acid and X is a softening comonomer, and a rigidifying polymer. The olefin includes ethylene, and the carboxylic acid includes acrylic acid, methacrylic acid, crotonic acid, maleic acid, fumaric acid, or itaconic acid. The non-ionomeric copolymer includes ethylene/acrylic acid copolymers or ethylene/methacrylic acid copolymers, and the non-ionomeric terpolymer includes ethylene/methyl acrylate/acrylic acid terpolymers, ethylene/n-butyl acrylate/methacrylic acid terpolymers, or ethylene/isobutyl acrylate/methacrylic acid terpolymers.

Preferably, the intermediate cover layer has a material hardness of 30 Shore D to 65 Shore D, and the inner cover layer has a thickness of 0.010 inches or greater, more preferably, 0.015 inches to 0.050 inches. In one embodiment, the inner cover layer includes a polyurethane, a polyurea, a polyurethane ionomer, an ionomer, a polyamide, a non-ionomeric polyolefin, a metallocene-catalyzed polymer, a polycarbonate, a styrene-butadiene block copolymer, a polyamide ester, a polyamide, and a polyester.

The inner cover layer should also have a material hardness of 50 Shore D or greater, more preferably 60 Shore D or greater, and also a flexural modulus of 50,000 psi or greater. In another embodiment, the outer cover layer typically has a material hardness of less than 60 Shore D, and the inner cover layer has a material hardness of greater than 60 Shore D.

In a preferred embodiment, at least one of the cover layers includes a highly neutralized ionomer being formed from a reaction between an ionomer having acid groups, a suitable cation source, and a salt of an organic acid, the cation source being present in an amount sufficient to neutralize the acid groups by at least 80%. The cation source is generally barium, lithium, sodium, zinc, bismuth, chromium, cobalt, copper, potassium, strontium, titanium, tungsten, magnesium, cesium, iron, nickel, silver, aluminum, tin, or calcium. Preferably, the highly neutralized ionomer is neutralized by at least 90%, most preferably 100%.

The core can have an outer diameter of between 1.25 inches and 1.62 inches, more preferably between 1.4 inches and 1.6 inches, and includes a high cis-polybutadiene, a high trans-polybutadiene, a polybutadiene, polyethylene copolymer, ethylene-propylene rubber, or ethylene-propylene-diene rubber. In a preferred embodiment, the core includes a fully neutralized ionomer being formed from a reaction between an ionomer having acid groups, a suitable cation source, and a salt of an organic acid, the cation source being present in an amount sufficient to neutralize the acid groups 100%.

The present invention is also directed to a golf ball comprising a core; and a cover comprising an inner cover layer comprising a non-ionomeric composition comprised of an acid copolymer or terpolymer having a formula of E/X/Y, where E is an olefin, Y is a carboxylic acid, and X is a softening comonomer; an outer cover layer comprising a castable polyurethane, a polyurea, a copolymer of a polyurethane, or a copolymer of a polyurea; and an intermediate cover layer disposed between the inner and outer cover layers comprising a partially-, highly-, or fully-neutralized ionomer.

The present invention is further directed to a golf ball comprising a core; and a cover comprising an inner cover layer comprising a partially-, highly-, or fully-neutralized ionomer; an outer cover layer comprising a castable polyurethane, a polyurea, a copolymer of a polyurethane, or a copolymer of a polyurea; and an intermediate cover layer disposed between the inner and outer cover layers comprising a non-ionomeric composition comprised of an acid copolymer or terpolymer having a formula of E/X/Y, where E is an olefin, Y is a carboxylic acid, and X is a softening comonomer.

DETAILED DESCRIPTION OF THE INVENTION

Figure 1:
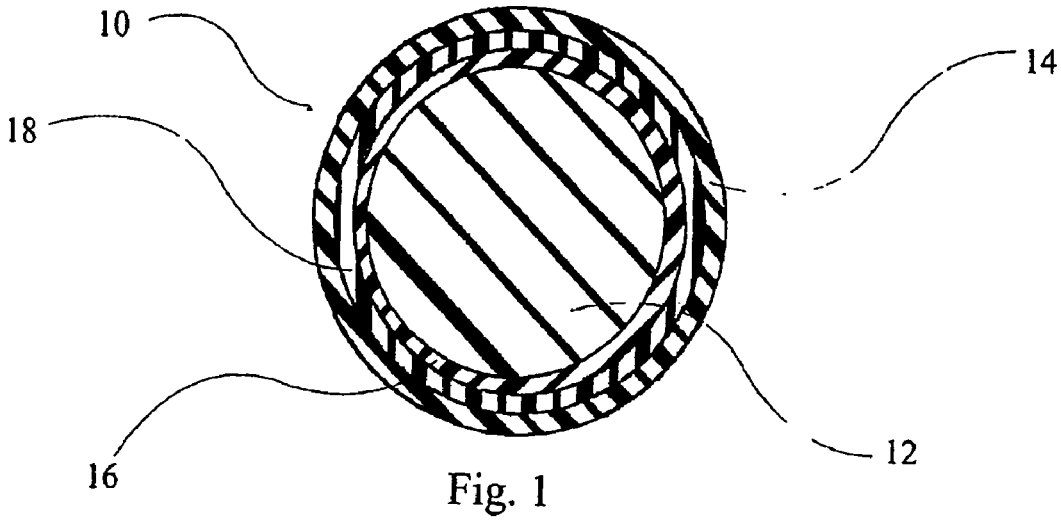
FIG. 1 is one embodiment of the golf ball of the present invention having a solid core and a cover comprising an outer cover layer, an intermediate cover layer, and an inner cover layer.
Figure 2:
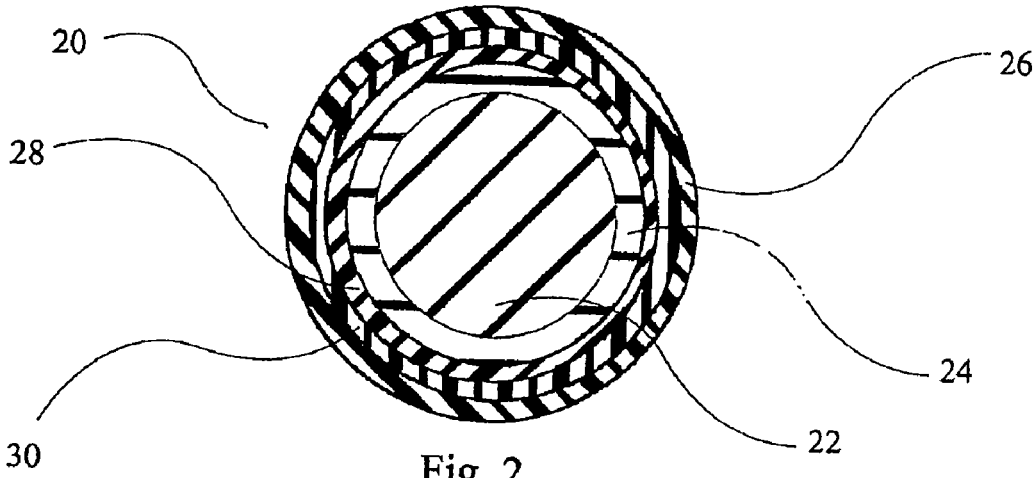
FIG. 2 is a second embodiment of the golf ball of the present invention having a core comprising a solid center and an outer core layer; and a cover comprising an outer cover layer, an intermediate cover layer, and an inner cover layer.
Figure 3:
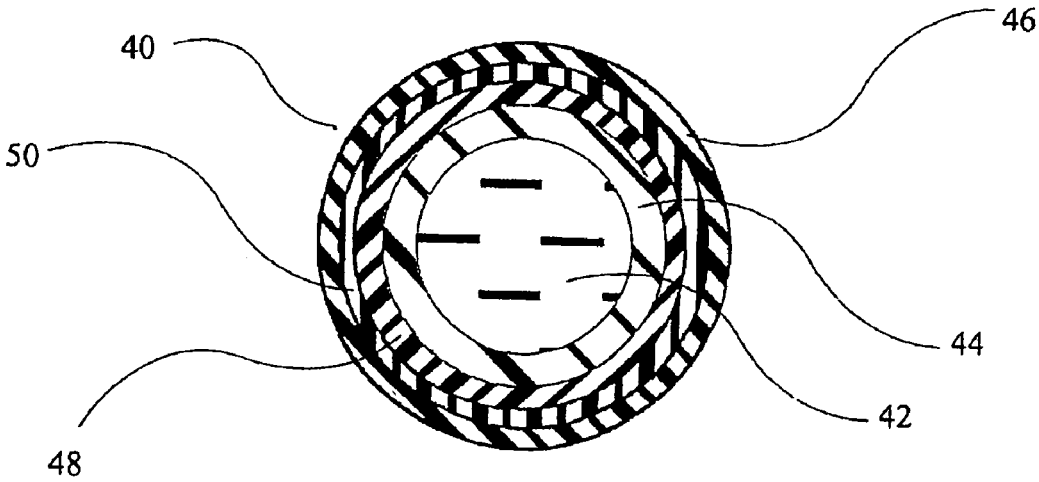
FIG. 3 is a third embodiment of the present invention having a liquid core comprising a liquid center and an outer core layer; and a cover comprising an outer cover layer, an intermediate cover layer, and an inner cover layer.

Referring to FIG. 1, a golf ball 10 of the present invention includes a core 12 and a cover comprising an outer cover 14 and at least two inner cover layers, such as an inner cover layer 16 and an intermediate cover layer 18. The golf ball cores of the present invention may be formed with a variety of constructions. For example, as seen in FIG. 2, a golf ball 20 may also comprise a core comprising a plurality of layers, such as a center 22 and an outer core layer 24, and a cover comprising an outer cover layer 26, an inner cover layer 28, and an intermediate cover layer 30. Referring to FIG. 3, the golf ball 40 may also comprise a core 44 comprising a solid, liquid, foam, gel, or hollow center 42, and a cover comprising an outer cover layer 46, an inner cover layer 48, and an intermediate cover layer 50. Any one of the inner cover layer 48 or the intermediate cover layer 50 may also comprise a tensioned elastomeric material. In a preferred embodiment, the core is a solid core.

The present invention is directed to a multi-layer golf ball comprising an outer cover layer, an intermediate cover layer, an inner cover layer and a core that may either be a single piece core, or a multi-piece core. In one embodiment, at least two of the three cover layers comprise non-ionomeric materials. In another embodiment, at least the intermediate cover layer comprises non-ionomeric materials. In a different embodiment, all three layers comprise non-ionomeric materials.

The outer cover layer of the present invention has a thickness of about 0.001 to 0.050 inches. In a different embodiment, the thickness of the outer cover layer is preferably about 0.005 to 0.035 inches. In another embodiment, the thickness of the outer cover layer is most preferably about 0.010 to 0.030 inches.

The intermediate cover layer of the present invention has a thickness of about 0.005 to 0.050 inches. In a different embodiment, the thickness of the intermediate cover layer is preferably about 0.010 to 0.020 inches. In another embodiment, the thickness of the intermediate cover layer is most preferably about 0.015 inches.

The inner cover layer of the present invention has a thickness of about 0.010 to 0.100 inches. In a different embodiment, the thickness of the inner cover layer is preferably about 0.015 to 0.050 inches. In another embodiment, the thickness of the inner cover layer is most preferably about 0.030 inches.

The outer layer of the present invention has a hardness of less than 60 Shore D.

The intermediate cover layer of the present invention has a hardness of about 30 to 65 Shore D.

The inner cover layer of the present invention has a hardness of more than 50 Shore D. In a different embodiment, the hardness of the inner cover layer is preferably more than about 60 Shore D. In another embodiment, the hardness of the inner cover layer is most preferably more than about 65 Shore D.

The inner cover layer preferably has a relatively high flexural modulus value. In one embodiment, the flexural modulus of the inner cover layer is greater than 50,000 psi. In a preferred embodiment, the flexural modulus of the inner cover layer is greater than 60,000 psi.

In a preferred embodiment, the outer cover layer is the softest cover layer, and the inner cover layer is the hardest cover layer.

The outer cover layer of this invention is made of non-ionomeric compositions comprising a polyurethane, a polyurea, or copolymer thereof, or polyurethane-ionomer copolymer, or blends thereof in an interpenetrating polymer network. Polyurethane is a product of a reaction between at least one isocyanate, polyol, and curing agent. In addition, polyurea is a product of a reaction between at least one isocyanate, amine-terminated component, and curing agent. Suitable polyurethanes, polyureas, or copolymers thereof may be found in U.S. Publication No. 2004/0010096 by Rajagopalan et al., which is incorporated by reference in its entirety.

Isocyanates for use with the polyurethane prepolymer include aliphatic, cycloaliphatic, araliphatic, derivatives thereof, and combinations of these compounds having two or more isocyanate (NCO) groups per molecule. The isocyanates may be organic, modified organic, organic polyisocyanate-terminated prepolymers, and mixtures thereof. The isocyanate-containing reactable component may also include any isocyanate-functional monomer, dimer, trimer, or multimeric adduct thereof, prepolymer, low free isocyanate prepolymer, quasi-prepolymer, or mixtures thereof. Isocyanate-functional compounds may include monoisocyanates or polyisocyanates that include any isocyanate functionality of two or more.

Suitable isocyanate-containing components include diisocyanates having the generic structure: O═C═N—R—N═C═O, where R is preferably a cyclic or linear or branched hydrocarbon moiety containing from about 1 to 20 carbon atoms. The diisocyanate may also contain one or more cyclic groups. When multiple cyclic groups are present, linear and/or branched hydrocarbons containing from about 1 to 10 carbon atoms can be present as spacers between the cyclic groups. In some cases, the cyclic group(s) may be substituted at the 2-, 3-, and/or 4-positions, respectively. Substituted groups may include, but are not limited to, halogens, primary, secondary, or tertiary hydrocarbon groups, or a mixture thereof.

Unsaturated diisocyanates, i.e., aromatic compounds, may also be used with the present invention, although the use of unsaturated compounds in the prepolymer is preferably coupled with the use of a light stabilizer or pigment as discussed below. Examples of unsaturated diisocyanates include, but are not limited to, substituted and isomeric mixtures including 2,2'-, 2,4'-, and 4,4'-diphenylmethane diisocyanate (MDI), 3,3'-dimethyl-4,4'-biphenyl diisocyanate (TODI), toluene diisocyanate (TDI), polymeric MDI, carbodimide-modified liquid 4,4'-diphenylmethane diisocyanate, para-phenylene diisocyanate (PPDI), meta-phenylene diisocyanate (MPDI), triphenylmethane-4,4'-, and triphenylmethane-4,4"-triisocyanate, napthylene-1,5,-diisocyanate (NDI), 2,4'-, 4,4'-, and 2,2-biphenyl diisocyanate, polyphenyl polymethylene polyisocyanate (PMDI), and mixtures thereof.

Examples of saturated diisocyanates that can be used in the polyurethane prepolymer include, but are not limited to, ethylene diisocyanate; propylene-1,2-diisocyanate; tetramethylene diisocyanate; tetramethylene-1,4-diisocyanate; 1,6-hexamethylene-diisocyanate (HDI); octamethylene diisocyanate; decamethylene diisocyanate; 2,2,4-trimethylhexamethylene diisocyanate; 2,4,4-trimethylhexamethylene diisocyanate; dodecane-1,12-diisocyanate; cyclobutane-1,3-diisocyanate; cyclohexane-1,2-diisocyanate; cyclohexane-1,3-diisocyanate; cyclohexane-1,4-diisocyanate; methyl-cyclohexylene diisocyanate (HTDI); 2,4-methylcyclohexane diisocyanate; 2,6-methylcyclohexane diisocyanate; 4,4'-dicyclohexyl diisocyanate; 2,4'-dicyclohexyl diisocyanate; 1,3,5-cyclohexane triisocyanate; isocyanatomethylcyclohexane isocyanate; 1-isocyanato-3,3,5-trimethyl-5-isocyanatomethylcyclohexane; isocyanatoethylcyclohexane isocyanate; bis(isocyanatomethyl)cyclohexane diisocyanate; 4,4'-bis(isocyanatomethyl) dicyclohexane; 2,4'-bis(isocyanatomethyl) dicyclohexane; isophorone diisocyanate (IPDI); triisocyanate of HDI; triisocyanate of 2,2,4-trimethyl-1,6-hexane diisocyanate (TMDI); 4,4'-dicyclohexylmethane diisocyanate ($H_{12}$MDI); 2,4-hexahydrotoluene diisocyanate; 2,6-hexahydrotoluene diisocyanate; aromatic aliphatic isocyanate, such as 1,2-, 1,3-, and 1,4-xylene diisocyanate; meta-tetramethylxylene diisocyanate (m-TMXDI); para-tetramethylxylene diisocyanate (p-TMXDI); trimerized isocyanurate of any polyisocyanate, such as isocyanurate of toluene diisocyanate, trimer of diphenylmethane diisocyanate, trimer of tetramethylxylene diisocyanate, isocyanurate of hexamethylene diisocyanate, isocyanurate of isophorone diisocyanate, and mixtures thereof; dimerized uretdione of any polyisocyanate, such as uretdione of toluene diisocyanate, uretdione of hexamethylene diisocyanate, and mixtures thereof; modified polyisocyanate derived from the above isocyanates and polyisocyanates; and mixtures thereof. In one embodiment, the saturated diisocyanates include isophorone diisocyanate (IPDI), 4,4'-dicyclohexylmethane diisocyanate ($H_{12}$MDI), 1,6-hexamethylene diisocyanate (HDI), or a combination thereof.

Prepolymers may contain about 10 percent to about 20 percent by weight of the low free isocyanate monomer. Thus, in one embodiment, the prepolymer may be stripped of the free isocyanate monomer. For example, after stripping, the prepolymer may contain about 1 percent or less free isocyanate monomer. In another embodiment, the prepolymer contains about 0.5 percent by weight or less of free isocyanate monomer. In still another embodiment, the prepolymer contains about 0.1 percent or less free isocyanate monomer.

When the composition of the invention is thermoplastic, suitable diisocyanates for use in the present invention include 2,2'-diphenylmethane diisocyanate, 2,4'-diphenylmethane diisocyanate, 4,4'-diphenylmethane diisocyanate; polymeric MDI; liquid MDI; toluene diisocyanate; 3,3'-dimethyl-4,4'-biphenylene diisocyanate; para-phenylene diisocyanate; isophorone diisocyanate; 4,4'-dicyclohexylmethane diisocyanate; 1,6-hexamethylene diisocyanate; p-tetramethylxylene diisocyanate; m-tetramethylxylene diisocyanate; naphthalene diisocyanate; m-phenylene diisocyanate; and mixtures thereof. In one embodiment, the prepolymer contains about 0.1 percent or less free isocyanate monomer.

In another embodiment, the diisocyanate is an aromatic diisocyanate containing about 4 to about 20 carbon atoms. Non-limiting examples include 1,4-diisocyanatobenzene, 1,5-naphthalene diisocyanate, xylene diisocyanate, isomers of toulene diisocyanate, or most preferably, 2,2' methylenebis(phenylisocyanate), 2,4' methylenebis(phenylisocyanate), 4,4' methylenebis(phenylisocyanate), isomers thereof or oligomers thereof. Acceptable aliphatic diisocyanates include 1,6-hexamethylene diisocyanate, isophorone diisocyanate, methylene bis(4-cyclohexylisocyanate) 1,4-cyclohexyl diisocyanate and the like.

The diisocyanate is preferably present in an amount from about 2.5 to about 15 percent by weight of the prepolymer, and more preferably, from about 2.5 to about 14 percent by weight of the prepolymer. In one embodiment, the diisocyanate is present in an amount from about 5 to about 12 percent by weight of the prepolymer. In another embodiment, prepolymer contains about 5 percent to about 10 percent by weight of diiscyanate.

Any polyol available to one of ordinary skill in the art is suitable for use in the polyurethane prepolymer. Suitable polyols include, but are not limited to, polyether polyols, polyester polyols, polycaprolactone polyols, polycarbonate polyols, hydrocarbon polyols, and mixtures thereof.

Examples of suitable polyether polyols include, but are not limited to, polytetramethylene ether glycol (PTMEG), copolymer of polytetramethylene ether glycol and 2-methyl-1,4-butane diol (PTG-L), poly(oxyethylene) glycol, poly (oxypropylene) glycol, poly(oxyethylene oxypropylene) glycol, ethylene oxide capped poly(oxypropylene) glycol, and mixtures thereof. Commercially available polyether-type polyurethanes are available from B.F. Goodrich under the names ESTANE® 5740×820 and 5740×955. Both materials having a Shore D hardness of less than 30, a flexural modulus of less than 5,000 psi and a percent rebound resilience of greater than about 45 percent.

Suitable polyester polyols include, but are not limited to, o-phthalate-1,6-hexanediol, polyethylene adipate glycol, polyethylene propylene adipate glycol, polyethylene butylene adipate glycol, polybutylene adipate glycol, polyhexamethylene adipate glycol, polyhexamethylene butylene adipate glycol, polyethylene terephthalate polyester polyol, and mixtures thereof.

Suitable polycaprolactone polyols include, but are not limited to, ethylene glycol initiated polycaprolactone; diethylene glycol initiated polycaprolactone; propylene glycol initiated polycaprolactone; dipropylene glycol initiated polycaprolactone; trimethylol propane initiated polycaprolactone; neopentyl glycol initiated polycaprolactone; 1,4-butanediol-initiated polycaprolactone; 1,6-hexanediol-initiated polycaprolactone; polytetramethylene ether glycol-initiated polycaprolactone; copolymers thereof; and mixtures thereof. As used herein, the term "copolymer" refers to a polymer that is formed from two or more monomers, wherein said monomers are not identical.

Examples of polycarbonate polyols that may be used with the present invention include, but are not limited to, poly (phthalate carbonate) glycol, poly(hexamethylene carbonate) glycol polycarbonate polyols containing bisphenol A, and mixtures thereof. Hydrocarbon polyols include, but are not limited to, hydroxy-terminated liquid isoprene rubber (LIR), hydroxy-terminated polybutadiene polyol, hydroxy-terminated polyolefin polyols, hydroxy-terminated hydrocarbon polyols, and mixtures thereof. Other aliphatic polyols that may be used to form the prepolymer of the invention include, but are not limited to, glycerols; castor oil and its derivatives; POLYTAIL® H; POLYTAIL® HA; KRATON® polyols; acrylic polyols; acid functionalized polyols based on a carboxylic, sulfonic, or phosphoric acid group; dimer alcohols converted from the saturated dimerized fatty acid; and mixtures thereof.

Suitable moisture resistant polyols include saturated and unsaturated hydrocarbon polyols, hydroxy-terminated liquid isoprene rubber, hydroxy-terminated polybutadiene polyol; copolymers and mixtures thereof.

In one embodiment, preferred polyols for use with the invention include, polytetramethylene ether glycol, polyethylene adipate glycol polybutylene adipate glycol, and diethylene glycol initiated polycaprolactone; copolymers and mixtures there of. In another embodiment, the polyol has a molecular weight from about 200 to 4000.

In yet another embodiment, the polyol is a hydroxyl terminated polyether with alkylene oxide repeat units containing from 2 to 6 carbon atoms and an average molecular weight of about 1,400 to about 10,000, preferably about 2,500 to about 10,000. The term "about," as used herein in connection with one or more numbers or numerical ranges, should be understood to refer to all such numbers, including all numbers in a range. In this aspect of the invention, representative alkylene oxide repeat group with 2 to 6 carbon atoms include, but are not limited to, ethylene oxide or propylene oxide with 4 carbon atoms. In one embodiment, tetramethylene, butylene oxide, and mixtures thereof are chosen as the alkylene oxide repeat units. Examples of commercially available hydroxyl terminated polyethers include Polymeg 2000 from Lyondell Chemical Co. and Terethane 2900 from DuPont.

Preferably, the polyol is present in an amount of about 70 to 98 percent by weight of the diisocyanate and the polyol, the diisocyanate is present in an amount of about 2 to 30 percent by weight of the diisocyanate and the polyol, and the diol and/or secondary diamine curing agent is present in an amount of about 10 to 110 weight percent of the diisocyanate and the polyol.

Any amine-terminated component available to one of ordinary skill in the art is suitable for use in making a polyurea prepolymer of the invention. The amine-terminated component may include amine-terminated hydrocarbons, amine-terminated polyethers, amine-terminated polyesters, amine-terminated carbonates, amine-terminated caprolactones, and mixtures thereof, as detailed in co-pending U.S. patent application Ser. No. 10/409,144, filed Apr. 9, 2003, entitled "Polyurea and Polyurethane Compositions for Golf Equipment" and U.S. patent Ser. No. 10/228,311, filed Aug. 27, 2002, entitled "Golf Balls Comprising Light Stable Materials and Methods of Making Same," which are incorporated by reference herein in their entirety. The amine-terminated segment may be in the form of a primary amine ($NH_2$) or a secondary amine (NHR). It is important to note that the use of an amine-terminated component in place of a polyol creates a polyurea prepolymer with only urea linkages. However, if the prepolymer includes low free isocyanate monomer and a hydroxy-terminated compound such as the polyols listed above are blended with the prepolymer, the resultant prepolymer will contain urethane linkages. Thus, the only way to achieve a pure polyurea composition is to ensure no urethane linkages are present in the composition.

Examples of amines that may be used include, but not limited to, 3,5-dimethylthio-2,4-toluenediamine; 3,5-diethyltoluene-2,4-diamine, 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and mixtures thereof.

Curatives for use with the present invention include, but are not limited to, hydroxy terminated curing agents, amine-terminated curing agents, and mixtures thereof. Depending on the type of curing agent used, the polyurethane composition may be thermoplastic or thermoset in nature. For example, polyurethanes prepolymers cured with a diol or secondary diamine with 1:1 stoichiometry are generally thermoplastic in nature. Thermoset polyurethanes, on the other hand, are generally produced from a prepolymer cured with a primary diamine or polyfunctional glycol.

In one embodiment, the compositions of the invention contain a single curing agent. In another embodiment, the compositions of the invention contain a mixture of curing agents. In yet another embodiment, the polyurethane composition contains a single diol curing agent.

In addition, the type of curing agent used may determine whether the polyurethane composition is polyurethane-urethane, polyurethane-urea, polyurea-urea, or polyurea-urethane. For example, a polyurethane prepolymer cured with a hydroxy-terminated curing agent is polyurethane-urethane because any excess isocyanate groups will react with the hydroxyl groups of the curing agent to create more urethane linkages. In contrast, if an amine-terminated curing agent is used with the polyurethane prepolymer, the excess isocyanate groups will react with the amine groups of the amine-terminated curing agent to create urea linkages.

In one embodiment, the curing agent has one of the following chemical structures:

$$HO—(R^1—R^2)—OH,$$

$$HNR—(R^1—R^2)_n—NHR,$$

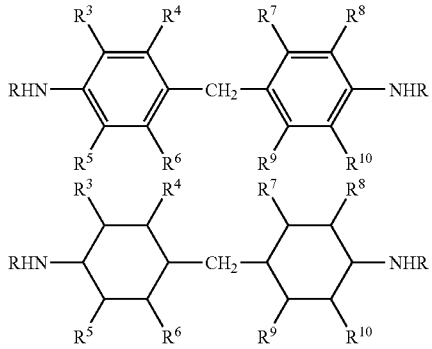

and mixtures thereof, wherein R includes alkyl groups, such as methyl, ethyl, propyl, butyl, and ethyl maleate groups, wherein $R^1$ and $R^2$ individually include linear or branched hydrocarbon chains having about 1 to about 20 carbon atoms, wherein $R^3$, $R^4$, $R^5$, $R^6$, $R^7$, $R^8$, $R^9$, and $R^{10}$ include a hydrogen atom, a methyl group, an ethyl group, a propyl group, a butyl group, or mixtures thereof, and wherein n ranges from about 1 to about 20.

Suitable hydroxy-terminated curing agents include, but are not limited to, ethylene glycol; diethylene glycol; polyethylene glycol; propylene glycol; 2-methyl-1,3-propanediol; 2-methyl-1,4-butanediol; dipropylene glycol; polypropylene glycol; ethanediol; 1,2-butanediol; 1,3-butanediol; 1,4-butanediol; 2,3-butanediol; 2,3-dimethyl-2,3-butanediol; trimethylolpropane; triisopropanolamine; diethylene glycol di-(aminopropyl) ether; 1,5-pentanediol; 1,6-hexanediol; cyclohexane diol; glycerol; 1,3-bis-(2-hydroxyethoxy) cyclohexane; 1,3-[bis-(2-hydroxyethoxy)]-diethoxy benzene; 1,4-cyclohexyldimethylol; 1,3-[2-(2-hydroxyethoxy)ethoxy]cyclohexane; 1,3-bis-{2-[2-(2-hydroxyethoxy)ethoxy]ethoxy}cyclohexane; polytetramethylene ether glycol having molecular weight ranging from about 250 to about 3900, preferably about 250 to about 1000; and mixtures thereof. It is well known in the art that 1,3-[bis-(2-hydroxyethoxy)]-diethoxy benzene may also be referred to as 2,2'-[1,3-phenylenebisoxy-2,1-ethanediyloxy]bis-ethanol.

In one embodiment, the composition of the invention is a thermoplastic polyurethane that includes a reaction product of 4,4'-diphenylmethane diisocyanate; polytetramethylene ether glycol; and mixtures of 1,3-bis-(2-hydroxyethoxy) benzene and 1,3-[bis-(2-hydroxyethoxy)]-diethoxy benzene.

The hydroxy-terminated curing agent preferably has a molecular weight of at least about 50. In one embodiment, the molecular weight of the hydroxy-terminated curing agent is about 2000 or less. In yet another embodiment, the hydroxy-terminated curing agent has a molecular weight of about 250 to about 3900. It should be understood that molecular weight, as used herein, is the absolute weight average molecular weight and would be understood as such by one of ordinary skill in the art.

When the curing agents are glycol chain extenders, i.e., glycol, ethylene glycol, propane glycol, butane glycol, pentane glycol, hexane glycol, benzene glycol, and xylene glycol, they are preferably straight chain. The total weight of any branches of the chain extenders based on all of the weight of all the chain extenders is preferably less than about 15 percent by weight. The curing agent may be aliphatic, aromatic, or a mixture thereof. The hydroxy-terminated curing agents may be selected from the polyols discussed above with respect to the prepolymer component of the compositions of the invention. For example, in one embodiment, the curing agent is a polyether polyol or hydroxy-terminated curing agent having the following structure:

$$HO—(R^1—O—R^2O)_m—H$$

where $R^1$ and $R^2$ are linear or branched hydrocarbon chains having about 1 to about 20 carbon atoms, and wherein n ranges from about 1 to about 45. The polyether polyol may include polytetramethylene ether glycol, poly(oxypropylene) glycol, poly(oxyethylene glycol), poly(oxyethylene oxypropylene) glycol, ethylene oxide capped poly(oxypropylene) glycol, and mixtures thereof. For example, a polyurethane composition of the invention may include PPDI and PTMEG, wherein the composition has a hardness of about 40 Shore D or greater, preferably about 45 Shore D to about 70 Shore D.

Other suitable curing agents may be found in U.S. Patent Publication No. 2004/0010096 by Rajagopalan et al. Furthermore, additional examples of suitable polyurethanes and polyureas for use with the present invention may be found in U.S. Patent Publication No. 2003/0088048, U.S. patent application Ser. No. 10/228,311, filed Aug. 27, 2002, entitled "Golf Balls Comprising Light Stable Materials and Methods of Making Same," U.S. patent application Ser. No. 10/339,603, filed Jan. 10, 2003, entitled "Polyurethane Compositions for Golf Balls," U.S. patent application Ser. No. 10/409,144, filed Apr. 9, 2003, entitled "Polyurea and Polyurethane Compositions for Golf Equipment," and U.S. patent application Ser. No. 10/409,092, filed Apr. 9, 2003, entitled "Water Resistant Polyurea Elastomers for Golf Equipment," the entire disclosures of which are incorporated by reference herein.

There are two basic techniques used to process the polyurethane and polyurea elastomers of the present invention: the one-shot technique and the prepolymer technique. The one-shot technique reacts the composition materials in one step, whereas the prepolymer technique requires a first reaction between the polyol and a diisocyanate to produce a polyurethane prepolymer or a first reaction between the amine-terminated compound and a diisocyanate to produce a polyurea prepolymer, and a subsequent reaction between the prepolymer and a curing agent. Either method may be employed to produce the polyurethane compositions of the invention, however, the prepolymer technique allows better control of chemical reaction and, consequently, may result in more uniform properties for the elastomers.

In one embodiment, the compositions of the invention are formed from a one-shot method by feeding: the diisocyanate monomer and then feeding at least one curing agent into an extruder to produce thermoplastic compositions for use in the golf balls of the invention. For example, melted PPDI monomer and curatives, such as PTMEG, polycaprolactone, and the like, may be fed into an extruder to make thermoplastic PPDI-based polyurethanes.

The compositions of the invention may be blended with other materials. For example, the compositions of the invention may be blended with an additional thermoplastic component. Suitable thermoplastic materials include, but are not limited to, copolyesters, polyamides, polyetherester block copolymers, polyesterester block copolymers, polyetheramide block copolymers, polyesteramide block copolymers, ionomer resins, dynamically vulcanized thermoplastic elastomers, hydrogenated styrene-butadiene elastomers with functional groups such as maleic anhydride or sulfonic acid attached, thermoplastic polyesters, polymers formed using a metallocene catalyst ("metallocene polymers") and mixtures thereof.

Optionally, the blended materials may form an interpenetrating polymer network (IPN). It has now been discovered that golf balls having an interpenetrating polymer network (IPN), including at least two polymeric components, can advantageously provide improved golf balls. An IPN useful for the present invention may include two or more different polymers or polymer networks and can encompass any one or more of the different types of IPNs listed and described below, which may overlap:

(1) Sequential IPN's, in which monomers or prepolymers for synthesizing one polymer or a polymer network are polymerized in the presence of another polymer or polymer network. These networks may have been synthesized in the presence of monomers or prepolymers of the one polymer or polymer network, which may have been interspersed with the other polymer or polymer network after its formation or cross-linking;

(2) Simultaneous IPN's, in which monomers or prepolymers of two or more polymers or polymer networks are mixed together and polymerized and/or crosslinked simultaneously, such that the reactions of the two polymer networks do not substantially interfere with each other;

(3) Grafted IPN's, in which the two or more polymers or polymer networks are formed such that elements of the one polymer or polymer network are occasionally attached or covalently or ionically bonded to elements of an/the other polymer(s) or polymer network(s);

(4) Semi-IPN's, in which one polymer is crosslinked to form a network while another, polymer is not; the polymerization or crosslinking reactions of the one polymer may occur in the presence of one or more sets of other monomers, prepolymers, or polymers, or the composition may be formed by introducing the one or more sets of other monomers, prepolymers, or polymers to the one polymer or polymer network, for example, by simple mixing, by solublizing the mixture, e.g., in the presence of a removable solvent, or by swelling the other in the one;

(5) Full, or "true," IPN's, in which two or more polymers or sets of prepolymers or monomers are crosslinked (and thus polymerized) to form two or more interpenetrating crosslinked networks made, for example, either simultaneously or sequentially, such that the reactions of the two polymer networks do not substantially interfere with each other;

(6) Homo-IPN's, in which one set of prepolymers or polymers can be further polymerized, if necessary, and simultaneously or subsequently crosslinked with two or more different, independent crosslinking agents, which do not react with each other, in order to form two or more interpenetrating polymer networks;

(7) Gradient IPN's, in which either some aspect of the composition, frequently the functionality, the copolymer content, or the crosslink density of one or more other polymer networks gradually vary from location to location within some, or each, other interpenetrating polymer network(s), especially on a macroscopic level;

(8) Thermoplastic IPN's, in which the crosslinks in at least one of the polymer systems involve physical crosslinks, e.g., such as very strong hydrogen-bonding or the presence of crystalline or glassy regions or phases within the network or system, instead of chemical or covalent bonds or crosslinks; and (9) Latex IPN's, in which at least one polymer or set of prepolymers or monomers are in the form of latices, frequently (though not exclusively) in a core-shell type of morphology, which form an interpenetrating polymer network when dried, for example, as a coating on a substrate (if multiple polymers or sets of prepolymers or monomers are in the form of lattices, this is sometimes called an "interpenetrating elastomer network," or IEN).

Other suitable embodiments of IPN may be found in commonly owned, co-pending U.S. Patent Application Publication No. 2002/0187857 by Kuntimaddi et al., which relates to a golf ball that contains at least two polymeric components in INP in any layer of the golf ball.

Suitable thermoplastic polyetherester block copolymers include materials that are commercially available from DuPont of Wilmington, Del., under the tradename HYTREL® and include HYTREL® 3078, HYTREL® G3548W, HYTREL® 4069 and HYTREL® G4078W. Suitable thermoplastic polyetheramide block copolymers are commercially available from Elf-Atochem of Philadelphia, Pa., under the tradename PEBAX® and include PEBAX® 2533, PEBAX® 1205 and PEBAX® 4033. Suitable thermoplastic ionomer resins include any number of olefinic-based ionomers such as SURLYN® (DuPont) and IOTEK® (Exxon). Suitable dynamically vulcanized thermoplastic elastomers include SANTOPRENE®, SARLINK®, VYRAM®, DYTRON®, and VISTAFLEX®. SANTOPRENE® is the trademark for a dynamically vulcanized PP/EPDM. SANTOPRENE® 203-40 is an example of a preferred SANTOPRENE® and is commercially available from Advanced Elastomer Systems. Examples of suitable functionalized hydrogenated styrene-butadiene elastomers having functional groups such as maleic anhydride or sulfonic acid, include KRATON® FG-1901.times.and FG-1921x, which are commercially available from the Shell Corporation. Examples of suitable thermoplastic polyurethanes include ESTANE® 58133, ESTANE® 58134 and ESTANE® 58144, which are commercially available from the B.F. Goodrich Company of Cleveland, Ohio. Suitable metallocene-catalyzed polymers, i.e., polymers formed with a metallocene catalyst, include those commercially available from Exxon and Dow. Suitable thermoplastic polyesters include poly(butylene terephthalate), poly(ethylene terephthalate), and poly(trimethylene terephthalate).

In one embodiment, a composition is formed according to the invention by reacting a diisocyanate with a hydroxyl terminated polyether and a glycol chain extender and further blended with a thermoplastic selected from the group of copolyesters, polyamides, polyetherester block copolymers, polyesterester block copolymers, polyetheramide block copolymers, polyesteramide block copolymers, other polyurethanes (such as poly(p-phenylene diisocyanate-ether) urethane and polyester-type urethane), and mixtures thereof. The resulting material preferably has a flexural modulus less than about 20,000 psi. In another embodiment, the thermoplastic component of the blend includes polyetherester block copolymer, preferably HYTREL® 4069.

The outer cover layer of this invention has a specific gravity in the range of 0.8 to 1.4. In a different embodiment, the specific gravity of the outer cover layer is 1.1 to 1.2. Nucleation of a RIM may achieve a specific gravity of 0.8 for the outer cover layer. Using a filled material can achieve a specific gravity up to 1.4.

The compositions for the intermediate cover layer and the inner cover layer may comprise of the same class of materials as described for the outer cover layer. In addition, these compositions may include any number of additional thermoplastic materials such as ionomers, polyamides, non-ionomeric polyolefins, metallocenes (fusabonds), polycarbonateds, thermoplastic elastomers such as styrene-butadiene block copolymers, amides-esters, amides, polyesters (HYTREL®, PEBAX®, etc.) or any materials described in U.S. Pat. No. 5,919,100 to Boehm, et al., which is incorporated by reference in its entirety. In another embodiment, at least one of the intermediate cover layer and the inner cover layer comprises an ionomer, high acid ionomer, terpolymer type ionomer, or a blend thereof.

In a different embodiment of this invention, the intermediate cover layer and the inner cover layer can include thermoplastic and thermosetting materials, but preferably include ionic copolymers of ethylene and an unsaturated monocarboxylic acid, such as SURLYN®, commercially available from E.I. DuPont de Nemours & Co., of Wilmington, Del., and IOTEK® or ESCOR®, commercially available from Exxon. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

In another embodiment of the intermediate cover layer and the inner cover layer preferably comprise of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly (phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof.

Still further, the intermediate cover layer and the inner cover layer preferably comprise of a polyether or polyester thermoplastic urethane, a thermoset polyurethane, an ionomer such as acid-containing ethylene copolymer ionomers, including E/X/Y copolymers where E is ethylene, X is an acrylate or methacrylate-based softening comonomer present in 5–35 weight percent and Y is alkyl acrylic or alkyl methacrylic acid present in 0–50 weight percent. The acrylic or methacrylic acid is present in 16–35 weight percent, making the ionomer a high modulus ionomer, in 10–12 weight percent, making the ionomer a low modulus ionomer or in 13–15 weight percent, making the ionomer a standard ionomer. Generally, high acid ionomers provide a harder, more resilient ionomer. Covers made using high acid ionomers usually provide a high initial velocity and a low spin rate. On the other hand, covers made with a low modulus ionomer are generally softer and provide greater spin and control.

In a different embodiment for the intermediate cover layer and the inner cover layer, another polymer particularly suitable for use in the reinforcing polymer component is a rigidifying polybutadiene component, which typically includes at least about 80 percent trans-isomer content with the rest being cis-isomer 1,4-polybutadiene and vinyl-isomer 1,2-polybutadiene. Thus, it may be referred to herein as a "high trans-isomer polybutadiene" or a "rigidifying polybutadiene" to distinguish it from the conventional cis-isomer polybutadienes or polybutadienes having a low trans-isomer content, i.e., typically below 80 percent, which are often used in forming golf ball cores and often used in the resilient polymer components discussed herein. Typically, the vinyl-content of the rigidifying polybutadiene component is present in no more than about 15 percent, preferably less than about 10 percent, more preferably less than about 5 percent, and most preferably less than about 3 percent of the polybutadiene isomers, with decreasing amounts being preferred. Without being bound by theory, it is believed that decreasing the vinyl-polybutadiene content increases resilience of the polymer and the material formed therewith.

In another embodiment of the intermediate cover layer and the inner cover layer, the compositions may utilize any of the materials according to commonly-owned U.S. patent application to Sullivan et al. (U.S. Patent Publication No. 2003/0125480), in which non-ionomeric inner layer compositions comprise a blend of an acid copolymer and a rigidifying polymer.

The rigidifying polybutadiene component for the intermediate cover layer and the inner cover layer, when used in the invention, also has a polydispersity of no greater than about 4, preferably no greater than about 3, and more preferably no greater than about 2.5. The polydispersity, or PDI, is a ratio of the molecular weight average ($M_w$) over the molecular number average ($M_n$) of a polymer.

In a different embodiment for the intermediate cover layer and the inner cover layer, the rigidifying polybutadiene component, when used in the invention, typically has a high absolute molecular weight average, defined as being at least about 100,000, preferably from about 200,000 to 1,000,000. In one embodiment, the absolute molecular weight average is from about 230,000 to 750,000 and in another embodiment it is from about 275,000 to 700,000. In any embodiment where the vinyl-content is present in greater than about 10 percent, the absolute molecular weight average is preferably greater than about 200,000.

When included in the at least one intermediate layer as part or all of the reinforcing polymer component, the rigidifying polybutadiene component of the invention may be produced by any means available to those of ordinary skill in the art, preferably with a catalyst that results in a rigidifying polybutadiene having at least 80 percent trans-content and a high absolute molecular weight average. A variety of literature is available to guide one of ordinary skill in the art in preparing suitable polybutadiene components for use in the invention, including U.S. Pat. Nos. 3,896,102, 3,926,933, 4,020,007, 4,020,008, 4,020,115, 4,931,376, 6,018,007, and 6,417,278, each of which is hereby incorporated by reference.

In a different embodiment of this invention, one of the three cover layers is made of highly neutralized polymer (HNP). HNP's are ionomers containing an acid group that is neutralized by a salt of an organic acid, the salt of the organic acid being present in an amount sufficient to neutralize the polymer by at least about 80%. In another embodiment, the polymer may be neutralized by about 90%. In a different embodiment, the polymer may be neutralized by about 100%. A number of partially or fully neutralized ionomers suitable for use in this invention are described in WO 00/23519, WO 01/29129. These ionomers can be of thermosetting or thermoplastic. For example, these ionomers can be formed from thermoplastic elastomers, functionalized styrene-butadiene elastomers, thermoplastic rubbers, thermoset elastomers, thermoplastic urethanes, metallocene polymers, urethanes, or ionomer resins, or blends thereof.

Suitable HNP thermoplastic ionomer resins for one of the three cover layers are obtained by providing a cross metallic bond to polymers of mono-olefin with at least one member selected from the group consisting of unsaturated mono- or di-carboxylic acids having 3 to 12 carbon atoms and esters thereof. The polymer contains 1 to 85% by weight of the unsaturated mono- or di-carboxylic acid and/or ester thereof. More particularly, low modulus ionomers, such as acid-containing ethylene copolymer ionomers, include E/X/Y copolymers where E is ethylene, X is acrylic or methacrylic acid present in 5–35 (preferably 10–35, most preferably 15–35) weight percent of the polymer, and Y is a softening co-monomer such as alkyl acrylate or alkyl methacrylate present in 0–50 (preferably 0–45, most preferably 0–35), weight percent of the polymer, wherein the acid moiety is neutralized 1–100% (preferably at least 40%, most preferably at least about 60%) to form an ionomer comprising a cation such as lithium, sodium, potassium, magnesium, calcium, barium, lead, tin, zinc or aluminum, or a combination of such cations. In another embodiment, lithium, sodium, magnesium and zinc are the preferred cations in these HNP's.

Examples of HNP's that are suitable for one of the cover layers in this invention are specific acid-containing ethylene copolymers, including ethylene/acrylic acid, ethylene/methacrylic acid, ethylene/acrylic acid/n-butyl acrylate, ethylene/methacrylic acid/n-butyl acrylate, ethylene/methacrylic acid/methyl acrylate, ethylene/methacrylic acid/methyl acrylate, ethylene/methacrylic acid/methyl methacrylate, and ethylene/acrylic acid/n-butyl methacrylate.

The preferred acid-containing ethylene copolymers suitable for one of the cover layers in this invention include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers.

The most preferred acid-containing ethylene copolymers suitable for one of the cover layers in this invention are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

In a different embodiment of this invention, HNP ionomer resins suitable for one of the cover layers in this invention include SURLYN® and IOTEK®, which are commercially available from DuPont and Exxon, respectively. Likewise, other conventional materials such as balata, elastomer and polyethylene may also be used.

U.S. Patent Application Publication Nos. 2003/0114565, and 2003/0050373, which are incorporated by reference herein in their entireties, discuss soft and high resilient HNP ionomers, which are preferably made from neutralizing the acid copolymer(s) of at least one E/X/Y copolymer, where E is ethylene, X is the α,β-ethylenically unsaturated carboxylic acid, and Y is a softening co-monomer. X is preferably present in 2–30 (preferably 4–20, most preferably 5–15) wt. % of the polymer, and Y is preferably present in 17–40 (preferably 20–40; and more preferably 24–35) wt. % of the polymer.

In a particular embodiment of this invention, the melt index (MI) of the base resin is at least 20, or preferably at least 40, more preferably at least 75 and most preferably at least 150. Particular soft, resilient ionomers included in this invention are partially neutralized ethylene/(meth)acrylic acid/butyl (meth)acrylate copolymers having an MI and level of neutralization that results in a melt processible polymer that has useful physical properties. The copolymers are at least partially neutralized. Preferably at least 40, or, more preferably at least 55, even more preferably about 70, and most preferably about 80 of the acid moiety of the acid copolymer is neutralized by one or more alkali metal, transition metal, or alkaline earth metal cations. Cations useful in making the ionomers of this invention comprise lithium, sodium, potassium, magnesium, calcium, barium, or zinc, or a combination of such cations.

The invention also relates to a "modified" soft, resilient thermoplastic HNP ionomer that comprises a melt blend of (a) the acid copolymers or the melt processible ionomers made therefrom as described above and (b) one or more organic acid(s) or salt(s) thereof, wherein greater than 80%, preferably greater than 90% of all the acid of (a) and of (b) is neutralized. Preferably, 100% of all the acid of (a) and (b) is neutralized by a cation source. Preferably, an amount of cation source in excess of the amount required to neutralize 100% of the acid in (a) and (b) is used to neutralize the acid in (a) and (b). Blends with fatty acids or fatty acid salts are preferred.

The organic acids or salts thereof are added in an amount sufficient to enhance the resilience of the copolymer. Preferably, the organic acids or salts thereof are added in an amount sufficient to substantially remove remaining ethylene crystallinity of the copolymer.

Preferably, the organic acids or salts are added in an amount of at least about 5% (weight basis) of the total amount of copolymer and organic acid(s). More preferably, the organic acids or salts thereof are added in an amount of at least about 15%, even more preferably at least about 20%. Preferably, the organic acid(s) are added in an amount up to about 50% (weight basis) based on the total amount of copolymer and organic acid. More preferably, the organic acids or salts thereof are added in an amount of up to about 40%, more preferably, up to about 35%. The non-volatile, non-migratory organic acids preferably are one or more aliphatic, mono-functional organic acids or salts thereof as described below, particularly one or more aliphatic, mono-functional, saturated or unsaturated organic acids having less than 36 carbon atoms or salts of the organic acids, preferably stearic acid or oleic acid. Fatty acids or fatty acid salts are most preferred.

Processes for fatty acid (salt) modifications are known in the art. Particularly, the modified highly-neutralized soft, resilient acid copolymer ionomers of this invention can be produced by:

(a) melt-blending (1) ethylene, $\alpha,\beta$-ethylenically unsaturated $C_{3-8}$ carboxylic acid copolymer(s) or melt-processible ionomer(s) thereof that have their crystallinity disrupted by addition of a softening monomer or other means with (2) sufficient non-volatile, non-migratory organic acids to substantially enhance the resilience and to disrupt (preferably remove) the remaining ethylene crystallinity, and then concurrently or subsequently;

(b) adding a sufficient amount of a cation source to increase the level of neutralization of all the acid moieties (including those in the acid copolymer and in the organic acid if the non-volatile, non-migratory organic acid is an organic acid) to the desired level.

With respect to the relative amounts of X and Y, the weight ratio of X to Y in the E/X/Y copolymer is at least about 1:20. Preferably, the weight ratio of X to Y is at least about 1:15, more preferably, at least about 1:10. Furthermore, the weight ratio of X to Y is up to about 1:1.67, more preferably up to about 1:2. Most preferably, the weight ratio of X to Y in the composition is up to about 1:2.2.

The acid copolymers used in the present invention to make the ionomers are preferably "direct" acid copolymers (containing high levels of softening monomers). As noted above, the copolymers are at least partially neutralized, preferably at least about 40% of X in the composition is neutralized. More preferably, at least about 55% of X is neutralized. Even more preferably, at least about 70, and most preferably, at least about 80% of X is neutralized. In the event that the copolymer is highly neutralized (e.g., to at least 45%, preferably 50%, 55%, 70%, or 80%, of acid moiety), the MI of the acid copolymer should be sufficiently high so that the resulting neutralized resin has a measurable MI in accord with ASTM D-1238, condition E, at 190° C., using a 2160-g weight. Preferably, this resulting MI will be at least 0.1, preferably at least 0.5, and more preferably 1.0 or greater. Preferably, for highly neutralized acid copolymer, the MI of the acid copolymer base resin is at least 20, or at least 40, at least 75, and more preferably at least 150.

The acid copolymers preferably comprise alpha olefin, particularly ethylene, $C_{3-8}$ $\alpha,\beta$-ethylenically unsaturated carboxylic acid, particularly acrylic and methacrylic acid, and softening monomers, selected from alkyl acrylate, and alkyl methacrylate, wherein the alkyl groups have from 1–8 carbon atoms, copolymers. By "softening", it is meant that the crystallinity is disrupted (the polymer is made less crystalline). While the alpha olefin can be a $C_2$–$C_4$ alpha olefin, ethylene is most preferred for use in the present invention. Accordingly, it is described and illustrated herein in terms of ethylene as the alpha olefin.

The organic acids employed for the HNP's may be aliphatic organic acids, aromatic organic acids, saturated mono-functional organic acids, unsaturated mono-functional organic acids, and multi-unsaturated mono-functional organic acids, particularly those having fewer than 36 carbon atoms. The salts of these organic acids may also be employed. Fatty acids or fatty acid salts are preferred. The salts may be any of a wide variety, particularly including the barium, lithium, sodium, zinc, bismuth, potassium, strontium, magnesium or calcium salts of the organic acids. Particular organic acids useful in the present invention include caproic acid, caprylic acid, capric acid, lauric acid, stearic acid, behenic acid, erucic acid, oleic acid, and linoleic acid.

The optional filler component is chosen to impart additional density to blends of the previously described components, the selection being dependent upon the different parts (e.g., cover, mantle, core, center, intermediate layers in a multilayered core or ball) and the type of golf ball desired (e.g., one-piece, two-piece, three-piece or multiple-piece ball), as will be more fully detailed below.

Generally, the filler will be inorganic having a density greater than about 4 grams/cubic centimeter (gm/cc), preferably greater than 5 gm/cc, and will be present in amounts between 0 to about 60 wt. % based on the total weight of the composition. Examples of useful fillers include zinc oxide, barium sulfate, lead silicate and tungsten carbide, as well as the other well-known fillers used in golf balls.

Additional optional additives useful in the practice of the subject invention include acid copolymer wax (e.g., Allied wax AC 143 believed to be an ethylene/16–18% acrylic acid copolymer with a number average molecular weight of 2,040), which assist in preventing reaction between the filler materials (e.g., ZnO) and the acid moiety in the ethylene copolymer. Other optional additives include $TiO_2$, which is used as a whitening agent, optical brighteners, surfactants, processing aids, etc.

HNP ionomers may be blended with conventional ionomeric copolymers (di-, ter-, etc.), using well-known techniques, to manipulate product properties as desired. The blends would still exhibit lower hardness and higher resilience when compared with blends based on conventional ionomers.

Also, HNP ionomers can be blended with non-ionic thermoplastic resins to manipulate product properties. The non-ionic thermoplastic resins would, by way of non-limiting illustrative examples, include thermoplastic elastomers, such as polyurethane, poly-ether-ester, poly-amide-ether, polyether-urea, PEBAX® (a family of block copolymers based on polyether-block-amide, commercially supplied by Atochem), styrene-butadiene-styrene (SBS) block copolymers, styrene(ethylene-butylene)-styrene block copolymers, etc., poly amide (oligomeric and polymeric), polyesters, polyolefins including PE, PP, E/P copolymers, etc., ethylene copolymers with various comonomers, such as vinyl acetate, (meth)acrylates, (meth)acrylic acid, epoxy-functionalized monomer, CO, etc., functionalized polymers with maleic anhydride grafting, epoxidization etc., elastomers, such as EPDM, metallocene catalyzed PE and copolymer, ground up powders of the thermoset elastomers, etc.

Such thermoplastic blends comprise about 1% to about 99% by weight of a first thermoplastic and about 99% to about 1% by weight of a second thermoplastic.

Additionally, U.S. Patent Application Publication No. 2003/0130434, and U.S. Pat. No. 6,653,382, both of which are incorporated herein in their entirety, discuss compositions having high coefficient of restitution ("COR") when formed into solid spheres. COR is an important measurement of the collision between the ball and a large mass. One conventional technique for measuring COR uses a golf ball or golf ball subassembly, air cannon, and a stationary vertical steel plate. The steel plate provides an impact surface weighing about 100 pounds or about 45 kilograms. A pair of ballistic light screens, which measure ball velocity, are spaced apart and located between the air cannon and the steel plate. The ball is fired from the air cannon toward the steel plate over a range of test velocities from 50 ft/s to 180 ft/s. Unless noted otherwise, all COR data presented in this application are measured using a speed of 125 ft/s. As the ball travels toward the steel plate, it activates each light screen so that the time at each light screen is measured. This provides an incoming time period proportional to the ball's incoming velocity. The ball impacts the steel plate and rebounds though the light screens, which again measure the time period required to transit between the light screens. This provides an outgoing transit time period proportional to the ball's outgoing velocity. The COR can be calculated by the ratio of the outgoing transit time period to the incoming transit time period.

Another method that measures COR uses a substantially fixed titanium disk. The titanium disk intending to simulate a golf club is circular, and has a diameter of about 4 inches, and has a mass of about 200 g. The impact face of the titanium disk may also be flexible and has its own coefficient of restitution, as discussed further below. The disk is mounted on an X-Y-Z table so that its position can be adjusted relative to the launching device prior to testing. A pair of ballistic light screens are spaced apart and located between the launching device and the titanium disk. The ball is fired from the launching device toward the titanium disk at a predetermined test velocity. As the ball travels toward the titanium disk, it activates each light screen so that the time period to transit between the light screens is measured. This provides an incoming transit time period proportional to the ball's incoming velocity. The ball impacts the titanium disk, and rebounds through the light screens which measure the time period to transit between the light screens. This provides an outgoing transit time period proportional to the ball's outgoing velocity. The COR can be calculated by the ratio of the outgoing time difference to the incoming time difference.

The thermoplastic composition of HNP's of this invention comprises a polymer which, when formed into a sphere that is 1.50 to 1.54 inches in diameter, has COR in the range of 0.807 to 0.837 using a steel plate.

The thermoplastic composition of this invention preferably comprises (a) aliphatic, mono-functional organic acid(s) having fewer than 36 carbon atoms; and (b) ethylene, $C_3$ to $C_8$ $\alpha,\beta$-ethylenically unsaturated carboxylic acid copolymer(s) and ionomer(s) thereof, wherein greater than 90%, preferably near 100%, and more preferably 100% of all the acid of (a) and (b) are neutralized.

The thermoplastic composition preferably comprises melt-processible, highly-neutralized (greater than 90%, preferably near 100%, and more preferably 100%) polymer of (1) ethylene, $C_3$ to $C_8$ $\alpha,\beta$-ethylenically unsaturated carboxylic acid copolymers that have their crystallinity disrupted by addition of a softening monomer or other means such as high acid levels, and (2) non-volatile, non-migratory agents such as organic acids (or salts) selected for their ability to substantially or totally suppress any remaining ethylene crystallinity. Agents other than organic acids (or salts) may be used.

It has been found that, by modifying an acid copolymer or ionomer with a sufficient amount of specific organic acids (or salts thereof), it is possible to highly neutralize the acid copolymer without losing processibility or properties such as elongation and toughness. The organic acids employed in the present invention are aliphatic, mono-functional, saturated or unsaturated organic acids, particularly those having fewer than 36 carbon atoms, and particularly those that are non-volatile and non-migratory and exhibit ionic array plasticizing and ethylene crystallinity suppression properties.

With the addition of sufficient organic acid, greater than 90%, nearly 100%, and preferably 100% of the acid moieties in the acid copolymer from which the ionomer is made can be neutralized without losing the processibility and properties of elongation and toughness.

The melt-processible, highly-neutralized acid copolymer ionomer can be produced by the following:

(a) melt-blending (1) ethylene $\alpha,\beta$-ethylenically unsaturated $C_{3-8}$ carboxylic acid copolymer(s) or melt-processible ionomer(s) thereof (ionomers that are not neutralized to the level that they have become intractable, that is not melt-processible) with (1) one or more aliphatic, mono-functional, saturated or unsaturated organic acids having fewer than 36 carbon atoms or salts of the organic acids, and then concurrently or subsequently (b) adding a sufficient amount of a cation source to increase the level of neutralization all the acid moieties (including those in the acid copolymer and in the organic acid) to greater than 90%, preferably near 100%, more preferably to 100%.

Preferably, highly-neutralized thermoplastics of the invention can be made by:

(a) melt-blending (1) ethylene, $\alpha,\beta$-ethylenically unsaturated $C_{3-8}$ carboxylic acid copolymer(s) or melt-processible ionomer(s) thereof that have their crystallinity disrupted by addition of a softening monomer or other means with (2) sufficient non-volatile, non-migratory agents to substantially remove the remaining ethylene crystallinity, and then concurrently or subsequently (b) Adding a sufficient amount of a cation source to increase the level of neutralization all the acid moieties (including those in the acid copolymer and in the organic acid if the non-volatile, non-migratory agent is an organic acid) to greater than 90%, preferably near 100%, more preferably to 100%.

The acid copolymers used in the present invention to make the ionomers are preferably "direct" acid copolymers. They are preferably alpha olefin, particularly ethylene, $C_{3-8}$ α,β-ethylenically unsaturated carboxylic acid, particularly acrylic and methacrylic acid, copolymers. They may optionally contain a third softening monomer. By "softening", it is meant that the crystallinity is disrupted (the polymer is made less crystalline). Suitable "softening" co-monomers are monomers selected from alkyl acrylate, and alkyl methacrylate, wherein the alkyl groups have from 1–8 carbon atoms.

The acid copolymers, when the alpha olefin is ethylene, can be described as E/X/Y copolymers where E is ethylene, X is the α,β-ethylenically unsaturated carboxylic acid, and Y is a softening comonomer. X is preferably present in 3–30 (preferably 4–25, most preferably 5–20) wt. % of the polymer, and Y is preferably present in 0–30 (alternatively 3–25 or 10–23) wt. % of the polymer.

Spheres were prepared using HNP ionomers A and B, as shown below.

TABLE I

| Sample | Resin Type (%) | Acid Type (%) | Cation (% neut*) | M.I. (g/10 min) |
|---|---|---|---|---|
| 1A | A(60) | Oleic (40) | Mg (100) | 1.0 |
| 2B | A(60) | Oleic (40) | Mg (105)* | 0.9 |
| 3C | B(60) | Oleic (40) | Mg (100) | 0.9 |
| 4D | B(60) | Oleic (40) | Mg (105)* | 0.9 |
| 5E | B(60) | Stearic (40) | Mg (100) | 0.85 |

A - ethylene, 14.8% normal butyl acrylate, 8.3% acrylic acid
B - ethylene, 14.9% normal butyl acrylate, 10.1% acrylic acid
*indicates that cation was sufficient to neutralize 105% of all the acid in the resin and the organic acid.

These compositions were molded into 1.53-inch spheres for which data is presented in the following table.

TABLE II

| Sample | Atti Compression | COR @ 125 ft/s |
|---|---|---|
| 1A | 75 | 0.826 |
| 2B | 75 | 0.826 |
| 3C | 78 | 0.837 |
| 4D | 76 | 0.837 |
| 5E | 97 | 0.807 |

Further testing of commercially available highly neutralized polymers HNP1 and HNP2 had the following properties.

TABLE III

| Material Properties | HNP1 | HNP2 |
|---|---|---|
| Specific Gravity | 0.966 | 0.974 |
| Melt Flow, 190° C., 10-kg load | 0.65 | 1.0 |
| Shore D Flex Bar (40 hr) | 47.0 | 46.0 |

TABLE III-continued

| Material Properties | HNP1 | HNP2 |
|---|---|---|
| Shore D Flex Bar (2 week) | 51.0 | 48.0 |
| Flex Modulus, psi (40 hr) | 25,800 | 16,100 |
| Flex Modulus, psi (2 week) | 39,900 | 21,000 |
| DSC Melting Point (° C.) | 61.0 | 61/101 |
| Moisture (ppm) | 1500 | 4500 |
| Weight % Mg | 2.65 | 2.96 |

TABLE IV

| Solid Sphere Data | | | | | |
|---|---|---|---|---|---|
| Material | HNP1 | HNP2 | HNP2a | HNP1a | HNP1a/HNP2a (50:50 blend) |
| Spec. Grav. | 0.954 | 0.959 | 1.153 | 1.146 | 1.148 |
| Filler | None | None | Tungsten | Tungsten | Tungsten |
| Compression | 107 | 83 | 86 | 62 | 72 |
| COR | 0.827 | 0.853 | 0.844 | 0.806 | 0.822 |
| Shore D | 51 | 47 | 49 | 42 | 45 |
| Shore C | | | 79 | 72 | 75 |

These materials are exemplary examples of one of the three cover layers herein. Other suitable embodiments of the HNP may be found in commonly-owned co-pending U.S. patent application Ser. No. 10/797,699, which is incorporated by reference in its entirety.

In a different aspect of the invention, the HNP of one of the three cover layers may be blended with diene rubber (DR). In accordance to the "Nomenclature For Rubbers" by the Rubber Division of the American Chemical Society (available at www.rubber.org), DR may be natural rubber (NR), balata, gutta-percha, acrylate-butadiene rubber (ABR), bromo-isobutylene-isoprene rubber (BIIR), butadiene rubber (BR), chloro-isoprene-isoprene rubber (CIIR), chloroprene rubber (CR), ethylene-propylene-diene rubber (EPDM), ethylene-propylene rubber (EPM), guayule rubber (GR), hydrogenated acrylonitrile-butadiene rubber (HNBR), isobutylene-isoprene rubber (IIR), polyisobutylene rubber (IM), synthetic isoprene rubber (IR), acrylonitrile-butadiene rubber (NBR), acrylonitrile-chloroprene rubber (NCR), acrylonitrile-isoprene rubber (NIR), vinylpyridine-butadiene rubber (V0BR), vinylpyridine-styrene-butadiene rubber (VSBR), styrene-butadiene rubber (SBR), styrene-chloroprene rubber (SCR), styrene-isoprene rubber (SIR), carboxylic-styrene-butadiene rubber (XSBR), carboxylic-acrylonitrile-butadiene rubber (XNBR), any diene containing elastomer, and mixtures thereof.

Typically natural or synthetic base rubber is used, which includes polydienes, polyethylenes (PE), ethylene-propylene copolymers (EP), ethylene-butylene copolymers, polyisoprenes, polybutadienes (PBR), polystyrenebutadienes, polyethylenebutadienes, styrene-propylene-diene rubbers, ethylene-propylene-diene terpolymers (EPDM), fluorinated polymers thereof (e.g., fluorinated EP and fluorinated EPDM), and blends of one or more thereof. Preferred base rubbers are PBR and EPDM. Suitable PBR may have high 1,4-cis content (e.g., at least 60%, preferably greater than about 80%, more preferably at least about 90%, and most preferably at least about 95%), low 1,4-cis content (e.g., less than about 50%), high 1,4-trans content (e.g., at least about 40%, preferably greater than about 70%, such as about 75% or 80%, more preferably greater than about 90%, such as about 95%), low 1,4-trans content (e.g., less than about 40%), high 1,2-vinyl content (e.g., at least about 40%, such as about 50% or 60%, preferably greater than about 70%), or low 1,2-vinyl content (e.g., less than about 30%, such as about 5%, 10%, 12%, 15%, or 20%). PBR can have various combinations of cis-, trans-, and vinyl structures, such as having a trans-structure content greater than cis-structure content and/or 1,2-vinyl structure content, having a cis-structure content greater than trans-structure content and/or 1,2-vinyl structure content, or having a 1,2-vinyl structure content greater than cis-structure content or trans-structure content. Obviously, the various polybutadienes may be utilized alone or in blends of two or more thereof to formulate different compositions in forming golf ball components (cores, covers, and portions or layers within or in between) of any desirable physical and chemical properties and performance characteristics.

The base rubber may also be mixed with other elastomers, particularly diene and saturated rubbers, known in the art, such as natural rubbers, polyisoprene rubbers, styrene-butadiene rubbers, diene rubbers, saturated rubbers, polyurethane rubbers, polyurea rubbers, metallocene-catalyzed polymers, plastomers, and multi-olefin polymers (homopolymers, copolymers, and terpolymers) in order to modify the properties of the core. With a major portion (greater than 50% by weight, preferably greater than about 80%) of the base rubber being a polybutadiene or a blend of two, three, four or more polybutadienes, these other miscible elastomers are present in amounts of less than 50% by weight of the total base rubber, preferably in minor quantities such as less than about 30%, less than about 15%, or less than about 5%. In one embodiment, the polymeric composition comprises less than about 20% balata, such as 18% or less, or 10% or less, and preferably is substantially free of balata (i.e., less than about 2%).

Liquid vinyl 1,2-polybutadiene homopolymers and copolymers can have low to moderate viscosity, low volatility and emission, high boiling point (typically greater than 300° C.), and molecular weight of about 1,000 to about 5,000, preferably about 1,800 to about 4,000, more preferably about 2,000 to about 3,500. Commercial examples of these liquid vinyl 1,2-polybutadienes include RICON® 154 (90% high vinyl 1,2-polybutadiene having a molecular weight of about 3,200), RICON® 150 (70% high vinyl 1,2-polybutadiene having a molecular weight of about 2,400), and RICON® 100 (70% high vinyl 1,2-polybutadiene/styrene copolymer having a molecular weight of about 2,400), all of which are available from Ricon Resins, Inc. of Grand Junction, Colo.

The cis-to-trans catalyst or organosulfur compound, preferably halogenated, is a compound having cis-to-trans catalytic activity or a sulfur atom (or both), and is present in the polymeric composition by at least about 0.01 phr, preferably at least about 0.05 phr, more preferably at least about 0.1 phr, even more preferably greater than about 0.25 phr, optionally greater than about 2 phr, such as greater than about 2.2 phr, or even greater than about 2.5 phr, but no more than about 10 phr, preferably less than about 5 phr, more preferably less than about 2 phr, even more preferably less than about 1.1 phr, such as less than about 0.75 phr, or even less than about 0.6 phr. Useful compounds of this category include those disclosed in U.S. Pat. Nos. 6,525,141; 6,465,578; 6,184,301; 6,139,447; 5,697,856; 5,816,944; and 5,252,652; the disclosures of which are incorporated by reference in their entirety.

One group of suitable organosulfur compounds are halogenated thiophenols and metallic compounds thereof, which are exemplified by pentafluorothiophenol, 2-fluorothiophenol, 3-fluorothiophenol, 4-fluorothiophenol, 2,3-fluorothiophenol, 2,4-fluorothiophenol, 3,4-fluorothiophenol, 3,5-fluorothiophenol 2,3,4-fluorothiophenol, 3,4,5-fluorothiophenol, 2,3,4,5-tetrafluorothiophenol, 2,3,5,6-tetrafluorothiophenol, 4-chlorotetrafluorothiophenol, pentachlorothiophenol, 2-chlorothiophenol, 3-chlorothiophenol, 4-chlorothiophenol, 2,3-chlorothiophenol, 2,4-chlorothiophenol, 3,4-chlorothiophenol, 3,5-chlorothiophenol, 2,3,4-chlorothiophenol, 3,4,5-chlorothiophenol, 2,3,4,5-tetrachlorothiophenol, 2,3,5,6-tetrachlorothiophenol, pentabromothiophenol, 2-bromothiophenol, 3-bromothiophenol, 4-bromothiophenol, 2,3-bromothiophenol, 2,4-bromothiophenol, 3,4-bromothiophenol, 3,5-bromothiophenol, 2,3,4-bromothiophenol, 3,4,5-bromothiophenol, 2,3,4,5-tetrabromothiophenol, 2,3,5,6-tetrabromothiophenol, pentaiodothiophenol, 2-iodothiophenol, 3-iodothiophenol, 4-iodothiophenol, 2,3-iodothiophenol, 2,4-iodothiophenol, 3,4-iodothiophenol, 3,5-iodothiophenol, 2,3,4-iodothiophenol, 3,4,5-iodothiophenol, 2,3,4,5-tetraiodothiophenol, 2,3,5,6-tetraiodothiophenoland, the metal salts thereof, and mixtures thereof. The metal ions, when present and associated with the thiophenols, are chosen from zinc, calcium, magnesium, cobalt, nickel, iron, copper, sodium, potassium, and lithium, among others. Halogenated thiophenols associated with organic cations such as ammonium are also useful for the present invention.

More specifically, workable halogenated thiophenols include pentachlorothiophenol, zinc pentachlorothiophenol, magnesium pentachlorothiophenol, cobalt pentachlorothiophenol, pentafluorothiophenol, zinc pentafluorothiophenol, and blends thereof. Preferred candidates are pentachlorothiophenol (available from Strucktol Company of Stow, Ohio), zinc pentachlorothiophenol (available from eChinachem of San Francisco, Calif.), and blends thereof.

Another group of suitable organosulfur compounds are organic disulfides which include, without limitation, perhalogenated (i.e., fully halogenated) organic disulfides and organometallic disulfides. Perhalogenated compounds are preferably perfluorinated, perchlorinated, and/or perbrominated. Perhalogenated organic disulfides include perhalogenated derivatives of any and all organic disulfides known and/or available to one skilled in the art, which include those disclosed herein, such as ditolyl disulfides, diphenyl disulfides, quinolyl disulfides, benzoyl disulfides, and bis(4-acryloxybenzene)disulfide, among others. A particular example is perchloroditolyl disulfide. Organometallic disulfides include combinations of any metal cations disclosed herein with any organic disulfides disclosed herein. A particular example is zinc ditolyl disulfide.

Suitable crosslinking initiators include any known polymerization initiators known or available to one skilled in the art that are capable of generating reactive free radicals. Such initiators include, but are not limited to, sulfur and organic peroxide compounds. Preferred peroxide initiators are dialkyl peroxides which include, without limitation, di-t-amyl peroxide, di-t-butyl peroxide, t-butyl cumyl peroxide, di-cumyl peroxide (DCP), di(2-methyl-1-phenyl-2-propyl) peroxide, t-butyl 2-methyl-1-phenyl-2-propyl peroxide, di(t-buylperoxy)diisopropylbenzene (higher crosslinking efficiency, low odor and longer scorch time), 2,5-dimethyl-2,5-di(t-butylperoxy)hexane, 2,5-dimethyl-2,5-di(t-butylperoxy)hexyne-3,1,1-di(t-butylperoxy)-3,3,5-trimethylcyclohexane, 4,4-di(t-butylperoxy)-n-butylvalerate, and mixtures thereof. DCP is the most commonly used peroxide in golf ball manufacturing. Di(t-buylperoxy)-diisopropylbenzene is a preferred peroxide because of its higher crosslinking efficiency, low odor and longer scorch time, among other properties. It is also preferred to use a blend of DCP and di(t-buylperoxy)-diisopropylbenzene. In the pure form, the peroxide or blend of peroxides is used at an amount of about 0.25 phr to about 2.5 phr.

In one embodiment, suitable DR compositions that may be blended with HNP include: (a) regrinds of DR compositions, (b) sulfur-cured DR compositions, in which polymer chains are joined together by sulfur-sulfur bridges using a vulcanizing agent, or alternatively known as "pre-vulcanized" DR, and (c) peroxide-cured DR compositions, in which peroxides or free-radicals are used as crosslinking agents between rubber polymer chains, or alternatively known as "pre-crosslinked" DR.

"Regrind" refers to cured golf ball core stock or any excess flash generated during the molding process that have been ground into small particles. The regrinds may be put back into the core formulations as filler.

"Pre-vulcanized" materials include sulfur-based chemical compounds that already have been vulcanized, in particular, polymer chains joined together (i.e., crosslinked) by sulfur-sulfur bridges to give a three dimensional polymeric network.

Sulfur, in some instances, is a desirable cross-linking agent for vulcanization of natural rubbers because it provides the newly formed rubber articles with increased strength and excellent resistance to failure when flexed. Insoluble sulfur may be used in natural rubber compounds in order to promote adhesion, which is necessary for certain applications. These insoluble sulfur rubber mixtures, however, must be kept cool (<100° C.) or the amorphous polymeric form converts to rhombic crystals, which may destroy building tack and lead to failure of the bond. In addition to insoluble sulfur, sulfur donors may be used. Examples of sulfur donors include 4-morpholinyl-2-benzothiazole disulfide (MBSS), dipentamethylenethiuram hexasulfide (DPTH) and thiuram disulfides. These sulfur donors donate one atom of sulfur from their molecular structure for cross-linking purposes and thus provide thermal stability. Examples of preferred sulfur curing agents include, but are not limited to N-oxydiethylene 2-benzothiazole sulfenamide, N,N-diorthotolyguanidine, bismuth dimethyldithiocarbamate, N-cyclohexyl 2-benzothiazole sulfenamide, N,N-diphenylguanidine, or combinations thereof.

"Pre-crosslinked" materials include chemical compounds that already have been crosslinked, in particular, polymer chains that are joined together or crosslinked by peroxides or free radicals. Typically, pre-crosslinked materials contain polymer chains are joined together by chemical bridges that are not sulfur-sulfur bridges. For example, the polymer chains can contain peroxide moieties and/or free radicals that react with other peroxide moieties and/or free radicals of other polymer chains to form crosslinked material. In another example, peroxides, free radicals and/or free radical-generators are contacted with the polymer chains to facilitate crosslinking between polymer chains.

Peroxides can also be used as a cross-linking agent for natural rubbers because peroxides give carbon-carbon cross-links, which can provide rubber articles with increased resistance to heat, oxygen and compression set. Peroxides can be advantageous in cross-linking in that they can be used in polymer blends and also with fully saturated polymers that cannot be cross-linked by other methods. In peroxide cross-linking, exposure to air is generally avoided, sometimes by means of an antioxidant, such as polymerized 1,2-dihydro-2,2,4-trimethylquinoline. Coagents, such as multifunctional methacrylates, can also be used with peroxides to increase the state of cure.

Suitable peroxide curing agents are dicumyl peroxide; 2,5-dimethyl-2,5-di(t-butylperoxy) hexane; 2,5-dimethyl-2,5-di(t-butylperoxy) hexyne; 2,5-dimethyl-2,5-di(benzoylperoxy) hexane; 2,2'-bis(t-butylperoxy)-di-iso-propylbenzene; 1,1-bis(t-butylperoxy)-3,3,5-trimethyl cyclohexane; n-butyl 4,4-bis(t-butyl-peroxy) valerate; t-butyl perbenzoate; benzoyl peroxide; n-butyl 4,4'-bis(butylperoxy) valerate; di-t-butyl peroxide; 2,5-di-(t-butylperoxy)-2,5 dimethyl hexane; or combinations thereof.

In comparing the physical attributes of sulfur vulcanizing agents versus peroxide cross-linking agents, there are clear differences in the physical characteristics. For example, the molecular weights of vulcanizing agents (outside of insoluble sulfur) are generally lower than peroxide cross-linking agents. Further, the density of most of the vulcanizing agents is higher than the density of the peroxide cross-linking agents. When (a) regrinds of DR compositions, (b) pre-vulcanized or sulfur-cured DR compositions, and (c) pre-crosslinked DR compositions are blended with HNP, materials with different physical characteristics are resulted.

Further details of the use of pre-vulcanized or pre-crosslinked materials may be found in commonly-owned and co-pending U.S. patent application Ser. Nos. 10/606,841 and 10/607,133, which are incorporated by reference in their entireties. Also, further details as to the properties and formulations of the vulcanizing agents and peroxides may be found in U.S. Pat. No. 6,695,718 to Nesbitt, which is incorporated by reference in its entirety.

Other suitable materials for the outer cover layer, the intermediate cover layer, and the inner cover layer may be used in conjunction with homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes including those prepared from polyols and diisocyanates or polyisocyanates and those disclosed in U.S. Pat. Nos. 5,334,673; 6,210,294; 6,435,986; 6,476,176; 6,506,851; and 6,645,088.

(4) Polyureas such as those disclosed in U.S. Pat. No. 5,484,870 and U.S. Patent Application Publication No. 2004/0018895.

(5) Cationic and anionic polyurethane and polyurea ionomers, including:

(a) thermoplastic and thermoset cationic polyurethane and polyurea ionomers containing cationic moieties such as quaternized nitrogen groups associated with halide or acetate anion either on the pendant or polymer backbone of polyurethane or polyurea; or (b) thermoplastic and thermoset anionic polyurethane and polyurea ionomers containing anionic moieties such as carboxylate or sulfonate or phosphonate neutralized with counter cations either on the pendant or polymer backbone of polyurethane or polyurea.

(6) Non-elastic thermoplastics like polyesters and polyamides such as poly(hexamethylene adipamide) and others prepared from diamines and dibasic acids, as well as those from amino acids such as poly(caprolactam). Still further, non-elastic thermoplastics can include polyethylene terephthalate, polybutylene terephthalate, polyethylene terephthalate/glycol (PETG), polyphenylene oxide resins, and blends of non-elastic thermoplastics with SURLYN®, polyethylene, ethylene copolymers, ethylene-propylene diene terpolymer, etc.

(7) Acrylic resins and blends of these resins with poly vinyl chloride, elastomers, etc.

(8) Thermoplastic rubbers such as olefinic thermoplastic rubbers including blends of polyolefins with ethylene-propylene diene terpolymer.

(9) Thermoplastic elastomers including block copolymers of styrene and butadiene, or isoprene or ethylene-butylene rubber, copoly(ether-amides) such as PEBAX® sold by Elf-Atochem, copoly(ether-ester) block copolymer elastomers sold under the trademarks HYTREL® from DuPont and LOMOD® from General Electric Company of Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. Blends such as polyvinyl chloride with acrylonitrile butadiene styrene or ethylene vinyl acetate or other elastomers. Blends of thermoplastic rubbers with polyethylene, polypropylene, polyacetal, polyamides, polyesters, cellulose esters, etc.

(11) Saponified polymers and blends thereof, including: saponified polymers obtained by reacting copolymers or terpolymers having a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester with sufficient amount of an inorganic metal base. These saponified polymers can be blended with ionic and non-ionic thermoplastic and thermoplastic elastomeric materials to obtain a desirable property.

(12) Copolymer and terpolymers containing glycidyl alkyl acrylate and maleic anhydride groups, including: copolymers and terpolymers containing glycidyl alkyl acrylate and maleic anhydride groups with a first monomeric component having olefinic monomer from 2 to 8 carbon atoms, a second monomeric component comprising an unsaturated carboxylic acid based acrylate class ester having from 4 to 22 carbon atoms, and an optional third monomeric component comprising at least one monomer selected from the group consisting of carbon monoxide, sulfur dioxide, an anhydride, a glycidyl group and a vinyl ester. The above polymers can be blended with ionic and non-ionic thermoplastic and thermoplastic elastomeric materials to obtain a desirable mechanical property.

(13) Hi-crystalline acid copolymers and their ionomers, including: acid copolymers or its ionomer derivatives formed from an ethylene and carboxylic acid copolymer comprising about 5 to 35 percent by weight acrylic or methacrylic acid, wherein said copolymer is polymerized at a temperature of about 130° C. to about 200° C. and a pressure of about 20,000 psi to about 50,000 psi and wherein up to about 70 percent to of the acid groups were neutralized with a metal ion.

(14) Oxa acid compounds including those containing oxa moiety in the backbone having the formula:

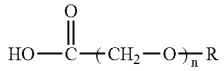

where R is an organic moiety comprising moieties having the formula:

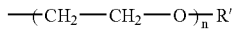

and alkyl, carbocyclic and heterocyclic groups; R' is an organic moiety comprising alkyl, carbocyclic, carboxylic acid, and heterocyclic groups; and n is an integer greater than 1. Also, R' can have the formula:

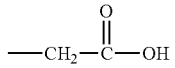

(15) Fluoropolymer including those having the following formula:

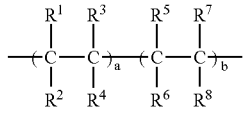

in which a is a number from 1 to 100, b is a number from 99 to 1, $R^1$–$R^7$ are independently selected from the group consisting of H, F, alkyl and aryl, and $R^8$ is F or a moiety of the formula:

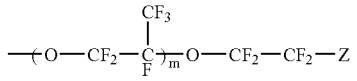

in which m is a number from 1 to 18 and Z is selected from the group consisting of $SO_2F$, $SO_3H$, $SO_3M^{\nu+}$, COF, $CO_2H$ and $CO_2M$ ν+, wherein ν is the valence of M and M is a cation selected from Group I, Ia, IIa, IIb, IIIa, IIIb, IVa, IVb and transition elements.

(16) Mg ionomers formed from an olefin and carboxyllic acid copolymer comprising about 5 to 35 weight percent of acrylic or methacrylic acid which are neutralized up to 60 weight percent by magnesium oxide or magnesium acetate or magnesium hydroxide.

The core of the present invention may comprise one or more pieces or layers. The overall diameter of the core is preferably greater than 1.0 inches, preferably between about 1.25 inches and about 1.62 inches, and most preferably, between about 1.4 inches and about 1.6 inches.

The core may be any type, such as solid one-piece or more pieces, solid liquid filled or hollow center, wound with liquid or solid, gel core, or any novel construction utilizing a thermoplastic, a thermoset or a combination thereof. A preferred embodiment of the core is a single core or dual type core comprising polybutadiene.

The core of this invention may be a thermoset composition such as high cis or trans polybutadiene. In a different embodiment, the core may be a thermoplastic metallocene or other single site catalyzed polyolefin such as polybutadiene, polyethylene copolymer, EPR or EPDM. In case of the metallocenes, the polymer may be crosslinked with a free radical source such as peroxide or by high energy radiation. In another embodiment, the core may also comprise materials such as those described in WO/0023519, WO/0129129, and U.S. Pat. Nos. 5,306,760 and 5,902,855. Other suitable thermoplastics for this invention may be found in U.S. Pat. No. 6,056,842 to Dalton et al., which is incorporated by reference in its entirety. It is preferred that the core be soft and fast, and the use of the latest ZnPCTP technology or any that achieves the same or better results. ZnPCTP is the zinc salt of pentachlorothiophenol (PCTP). Further details of the utilization of PCTP and ZnPCTP in golf ball cores to produce soft and fast cores may be found in U.S. Pat. No. 6,692,380 to Sullivan, et al., and U.S. Pat. No. 6,635,716 to Voorheis, et al. A suitable PCTP is sold by the Structol Company under the tradename A95. ZnPCTP is commercially available from EchinaChem.

Materials for solid cores include compositions having a base rubber, a filler, an initiator agent, and a crosslinking agent. The base rubber typically includes natural or synthetic rubber, such as polybutadiene rubber. A preferred base rubber is 1,4-polybutadiene having a cis-structure of at least 40%. Most preferably, however, the solid core is formed of a resilient rubber-based component comprising a high-Mooney-viscosity rubber and a crosslinking agent.

Another suitable rubber from which to form cores of the present invention is trans-polybutadiene, which may be formed by the partial conversion of the cis-isomer of the polybutadiene to the trans-isomer during a molding cycle. This polybutadiene isomer is formed by converting the cis-isomer of the polybutadiene to the trans-isomer during a molding cycle. Various combinations of polymers, cis-to-trans catalysts, fillers, crosslinkers, and a source of free radicals, may be used. A variety of methods and materials for performing the cis-to-trans conversion have been disclosed in U.S. Pat. Nos. 6,162,135; 6,465,578; 6,291,592; and 6,458,895, each of which are incorporated herein, in their entirety, by reference.

Additionally for the core of this invention, without wishing to be bound by any particular theory, it is believed that a low amount of 1,2-polybutadiene isomer ("vinyl-polybutadiene") is preferable in the initial polybutadiene. Typically, the vinyl polybutadiene isomer content is less than about 7 percent, more preferably less than about 4 percent, ans most preferably, less than about 2 percent.

In a different embodiment of the core of this invention, fillers added to one or more portions of the golf ball typically include processing aids or compounds to affect rheological and mixing properties, the specific gravity (i.e., density-modifying fillers), the modulus, the tear strength, reinforcement, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents, zinc carbonate, regrind (recycled core material typically ground to about 30 mesh or less particle size), high-Mooney-viscosity rubber regrind, and the like. Fillers are typically also added to one or more portions of the golf ball to modify the density thereof to conform to uniform golf ball standards. Fillers may also be used to modify the weight of the center or any or all core and cover layers, if present.

In another embodiment of the core of this invention, the initiator agent can be any known polymerization initiator which decomposes during the cure cycle. Suitable initiators include peroxide compounds such as dicumyl peroxide, 1,1-di(t-butylperoxy) 3,3,5-trimethyl cyclohexane, a-a bis (t-butylperoxy) diisopropylbenzene, 2,5-dimethyl-2,5 di(t-butylperoxy) hexane or di-t-butyl peroxide and mixtures thereof.

For a different embodiment of the core, crosslinkers are included to increase the hardness and resilience of the reaction product. The crosslinking agent includes a metal salt of an unsaturated fatty acid such as a zinc salt or a magnesium salt of an unsaturated fatty acid having 3 to 8 carbon atoms such as acrylic or methacrylic acid. Suitable cross linking agents include metal salt diacrylates, dimethacrylates and monomethacrylates wherein the metal is magnesium, calcium, zinc, aluminum, sodium, lithium or nickel. Preferred acrylates include zinc acrylate, zinc diacrylate, zinc methacrylate, and zinc dimethacrylate, and mixtures thereof.

For yet another embodiment of the core, the crosslinking agent must be present in an amount sufficient to crosslink a portion of the chains of polymers in the resilient polymer component. This may be achieved, for example, by altering the type and amount of crosslinking agent, a method well-known to those of ordinary skill in the art.

When the core is formed of a single solid layer comprising a high-Mooney-viscosity rubber, the crosslinking agent is present in an amount from about 5 to about 50 parts per hundred, more preferably from about 10 to about 40 parts per hundred, and most preferably about 15 to 30 parts per hundred.

In another embodiment of the present invention, the core comprises a solid center and at least one outer core layer. When the optional outer core layer is present, the center preferably comprises a high-Mooney-viscosity rubber and a crosslinking agent present in an amount from about 10 to about 30 parts per hundred of the rubber, preferably from about 19 to about 25 parts per hundred of the rubber, and most preferably from about 20 to 24 parts crosslinking agent per hundred of rubber.

The core composition of this invention comprise at least one rubber material having a resilience index of at least about 40. Preferably the resilience index is at least about 50. Polymers that produce resilient golf balls and, therefore, are suitable for the present invention, include but are not limited to CB23, CB22, BR60, and 1207G. As used herein the term "resilience index" is defined as the difference in loss tangent (tan δ) measured at 10 cpm and 1000 cpm divided by 990 (the frequency span) multiplied by 100,000 (for normalization and unit convenience). The loss tangent is measured using an RPA 2000 manufactured by Alpha Technologies of Akron, Ohio. The RPA 2000 is set to sweep from 2.5 to 1000 cpm at a temperature of 100° C. using an arc of 0.5 degree. An average of six loss tangent measurements were acquired at each frequency and the average is used in calculation of the resilience index. The computation of resilience index is as follows:

$$\text{Resilience Index}=100{,}000\cdot[(\text{loss tangent@10 cpm})-(\text{loss tangent@1000 cpm})]/990$$

In another embodiment of the core of this invention, the unvulcanized rubber, such as polybutadiene, in golf balls prepared according to the invention typically has a Mooney viscosity of between about 40 and about 80, more preferably, between about 45 and about 60, and most preferably, between about 45 and about 55. Mooney viscosity is typically measured according to ASTM D-1646.

In a different embodiment of the core, the polymers, free-radical initiators, filler, crosslinking agents, and any other materials used in forming either the golf ball center or any portion of the core, in accordance with invention, may be combined to form a mixture by any type of mixing known to one of ordinary skill in the art. Suitable types of mixing include single pass and multi-pass mixing, and the like. The crosslinking agent, and any other optional additives used to modify the characteristics of the golf ball center or additional layer(s), may similarly be combined by any type of mixing. A single-pass mixing process where ingredients are added sequentially is preferred, as this type of mixing tends to increase efficiency and reduce costs for the process. The preferred mixing cycle is single step wherein the polymer, cis-to-trans catalyst, filler, zinc diacrylate, and peroxide are added sequentially.

For the core of this invention, suitable mixing equipment is well known to those of ordinary skill in the art, and such equipment may include a Banbury mixer, a two-roll mill, or a twin screw extruder. Conventional mixing speeds for combining polymers are typically used, although the speed must be high enough to impart substantially uniform dispersion of the constituents. On the other hand, the speed should not be too high, as high mixing speeds tend to break down the polymers being mixed and particularly may undesirably decrease the molecular weight of the resilient polymer component. The speed should thus be low enough to avoid high shear, which may result in loss of desirably high molecular weight portions of the polymer component. Also, too high a mixing speed may undesirably result in creation of enough heat to initiate the crosslinking before the preforms are shaped and assembled around a core. The mixing temperature depends upon the type of polymer components, and more importantly, on the type of free-radical initiator. Additionally, it is important to maintain a mixing temperature below the peroxide decomposition temperature. Suitable mixing speeds and temperatures are well-known to those of ordinary skill in the art, or may be readily determined without undue experimentation.

In a different embodiment of the core in this invention, the mixture can be subjected to compression or injection molding processes, for example, to obtain solid spheres for the core or hemispherical shells for forming an intermediate layer, such as an outer core layer or an inner cover layer. The polymer mixture is subjected to a molding cycle in which heat and pressure are applied while the mixture is confined within a mold. The cavity shape depends on the portion of the golf ball being formed. The molding cycle may have a single step of molding the mixture at a single temperature for a fixed time duration. The molding cycle may also include a two-step process, in which the polymer mixture is held in the mold at an initial temperature for an initial duration of time, followed by holding at a second, typically higher temperature for a second duration of time. In a preferred embodiment of the current invention, a single-step cure cycle is employed. Single-step processes are effective and efficient, reducing the time and cost of a two-step process.

Furthermore, the core and layers of the present invention may be reaction injection molded (RIM), liquid injection molded (LIM), or injection molded. In the most preferred embodiment, the layers of the present invention are reaction injection molded. In the RIM process, at least two or more reactive low viscosity liquid components are mixed by impingement and injected under high pressure (1200 psi or higher) into an open or closed mold. The reaction times for the RIM systems are much faster than the low pressure mixing and metered machines and, consequently, the raw materials used for the RIM process are generally much lower in viscosity to allow intimate mixing. A RIM machine can process fast reacting materials having viscosities up to about 2,000 cP and a pot life of less than about 5 seconds. Because low viscosity materials are used in the RIM process, the components are capable of being mixed by impingement in less than a second before injecting the mixed material into the closed mold at about 2,000 to about 2,500 psi. With a conventional castable urethane process, materials having viscosities greater than about 3,500 are required and also require a pot life of greater than about 35 seconds.

For the core in this invention, the polybutadiene, cis-to-trans conversion catalyst, if present, additional polymers, free-radical initiator, filler, and any other materials used in forming any portion of the golf ball core, in accordance with the invention, may be combined to form a golf ball layer by an injection molding process, which is also well-known to one of ordinary skill in the art. Although the curing time depends on the various materials selected, those of ordinary skill in the art will be readily able to adjust the curing time upward or downward based on the particular materials used and the discussion herein.

Due to the very thin nature, it has been found by the present invention that the use of a castable, reactive material, which is applied in a fluid form, makes it possible to obtain very thin outer cover layers on golf balls. Specifically, it has been found that castable, reactive liquids, which react to form a urethane elastomer material, provide desirable very thin outer cover layers.

The castable, reactive liquid employed to form the urethane elastomer material can be applied over the core using a variety of application techniques such as spraying, dipping, spin coating, or flow coating methods which are well known in the art. An example of a suitable coating technique is that which is disclosed in U.S. Pat. No. 5,733,428, filed May 2, 1995 entitled "Method And Apparatus For Forming Polyurethane Cover On A Golf Ball," the disclosure of which is hereby incorporated by reference in its entirety in the present application.

The outer cover is preferably formed around the core and intermediate cover layers by mixing and introducing the material in the mold halves. It is important that the viscosity be measured over time, so that the subsequent steps of filling each mold half, introducing the core into one half and closing the mold can be properly timed for accomplishing centering of the core cover halves fusion and achieving overall uniformity. Suitable viscosity range of the curing urethane mix for introducing cores into the mold halves is determined to be approximately between about 2,000 cP and about 30,000 cP, with the preferred range of about 8,000 cP to about 15,000 cP.

To start the outer cover formation, mixing of the prepolymer and curative is accomplished in a motorized mixer including mixing head by feeding through lines metered amounts of curative and prepolymer. Top preheated mold halves are filled and placed in fixture units using pins moving into holes in each mold. After the reacting materials have resided in top mold halves for about 40 to about 80 seconds, a core is lowered at a controlled speed into the gelling reacting mixture. At a later time, a bottom mold half or a series of bottom mold halves have similar mixture amounts introduced into the cavity.

A ball cup holds the ball core through reduced pressure (or partial vacuum). Upon location of the coated core in the halves of the mold after gelling for about 40 to about 80 seconds, the vacuum is released allowing core to be released. The mold halves, with core and solidified cover half thereon, are removed from the centering fixture unit, inverted and mated with other mold halves which, at an appropriate time earlier, have had a selected quantity of reacting polyurethane prepolymer and curing agent introduced therein to commence gelling.

Similarly, U.S. Pat. No. 5,006,297 to Brown et al. and U.S. Pat. No. 5,334,673 to Wu both also disclose suitable molding techniques which may be utilized to apply the castable reactive liquids employed in the present invention. Further, U.S. Pat. Nos. 6,180,040 and 6,180,722 disclose methods of preparing dual core golf balls. The disclosures of these patents are hereby incorporated by reference in their entirety.

Depending on the desired properties, balls prepared according to the invention can exhibit substantially the same or higher resilience, or coefficient of restitution ("COR"), with a decrease in compression or modulus, compared to balls of conventional construction. Additionally, balls prepared according to the invention can also exhibit substantially higher resilience, or COR, without an increase in compression, compared to balls of conventional construction.

When golf balls are prepared according to the invention, they typically will have dimple coverage greater than about 60 percent, preferably greater than about 65 percent, and more preferably greater than about 75 percent. The flexural modulus of the cover on the golf balls, as measured by ASTM method D6272-98, Procedure B, is typically greater than about 500 psi, and is preferably from about 500 psi to 150,000 psi.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other. As used herein, the term "hardness" refers to material hardness, as defined above.

EXAMPLES

The following examples are part of a study to compare the three-cover layer golf balls with the two-cover layer golf balls.

TABLE V

Physical Properties Of Golf Balls In Study

| Examples | Ball Type | No. of Cover Layers | Materials | Compression (Atti) | Weight (oz) | Hardness of Cover (Shore D) | Coefficient of Restitution |
|---|---|---|---|---|---|---|---|
| Comparative Example 1 | Pinnacle Gold Distance | 1 | Ionomeric | 86 | 1.606 | 68 | 0.805 |
| Comparative Example 2 | Ionomeric Casing/ 45D Urethane | 2 | Ionomeric Nonionomeric | 85 | 1.607 | 58 | 0.804 |
| Comparative Example 3 | Ionomeric Casing/ 45D Urethane | 2 | Ionomeric Nonionomeric | 92 | 1.608 | 58 | 0.790 |
| Comparative Example 4 | Nucrel 960/ 55D Urethane | 2 | Nonionomeric Nonionomeric | 84 | 1.619 | 58 | 0.765 |
| Comparative Example 5 | Surlyn 9120/ 45D Urethane | 2 | Ionomeric Nonionomeric | 92 | 1.614 | 58 | 0.790 |
| Comparative Example 6 | BIIM Ball Bridgestone, Japan | 3 | | 86 | 1.595 | 67 | 0.811 |
| Inventive Example 1 | Surlyn 9120/ Nucrel 960/ 55D Urethane | 3 | Ionomeric Nonionomeric Nonionomeric | 91 | 1.620 | 59 | 0.784 |
| Inventive Example 2 | Nucrel 960/ Surlyn 9120/ 45D Urethane | 3 | Nonionomeric Ionomeric Nonionomeric | 87 | 1.610 | 56 | 0.778 |
| Inventive Example 2 | Surlyn 9120/ Nucrel 960/ 45D Urethane | 3 | Ionomeric Nonionomeric Nonionomeric | 85 | 1.611 | 53 | 0.781 |

(1) 45D or 55D Urethane indicates a polyurethane having a hardness of 45 or 55 on the Shore D scale.
(2) Surlyn 9120 is partially neutralized ionomeric ethylene/methacrylic acid copolymer available from DuPont.
(3) Nucrel 960 is a non-ionomeric ethylene/methacrylic acid copolymer available from DuPont.

For the two-cover layer balls (Comparative Examples 2–5), the outer diameters for the core, the inner cover layer and the outer cover layer are, respectively, 1.510 inches, 1.620 inches and 1.685 inches. For the three-cover layer balls (Inventive Examples 1–3), the outer diameters for the core, the inner cover layer, the intermediate cover layer, and the outer cover layer are, respectively, 1.510 inches, 1.590 inches, 1.620 inches, and 1.685 inches.

TABLE VI

Comparison of Spins Using (a) Standard Driver at 150 mph, (b) 8 Iron, (c) Full Wedge, and (d) Half Wedge.

| Examples | Ball Type | No. of Cover Layers | Materials | Standard Driver | 8 Iron | Full Wedge | Half Wedge |
|---|---|---|---|---|---|---|---|
| Comparative Example 1 | Pinnacle Gold Distance | 1 | Ionomeric | 2779 | 8226 | 8558 | 5112 |
| Comparative Example 2 | Ionomeric Casing/ 45D Urethane | 2 | Ionomeric Nonionomeric | 3142 | 8339 | 9462 | 7039 |
| Comparative Example 3 | Ionomeric Casing/ 45D Urethane | 2 | Ionomeric Nonionomeric | 3065 | 8262 | 9359 | 7052 |
| Comparative Example 4 | Nucrel 960/ 55D Urethane | 2 | Nonionomeric Nonionomeric | 3040 | 7994 | 9141 | 6632 |
| Comparative Example 5 | Surlyn 9120/ 45D Urethane | 2 | Ionomeric Nonionomeric | 3070 | 8184 | 9321 | 7015 |
| Comparative Example 6 | BIIM Ball Bridgestone, Japan | 3 | | 2817 | 8389 | 8660 | 5011 |
| Inventive Example 1 | Surlyn 9120/ Nucrel 960/ 55D Urethane | 3 | Ionomeric Nonionomeric Nonionomeric | 2989 | 7919 | 9151 | 6711 |
| Inventive Example 2 | Nucrel 960/ Surlyn 9120/ 45D Urethane | 3 | Nonionomeric Ionomeric Nonionomeric | 3075 | 8170 | 9266 | 6933 |
| Inventive Example 2 | Surlyn 9120/ Nucrel 960/ 45D Urethane | 3 | Ionomeric Nonionomeric Nonionomeric | 3159 | 8252 | 9290 | 7038 |

From Table VI, using the standard driver, the spin values of 2989, 3075 and 3159 of the three-layer cover balls (Inventive Examples 1–3, respectively) are comparable to the spin values of 3142, 3065, 3040 and 3070 3058 of the two-layer cover balls (Comparative Examples 2–5, respectively).

Using the 8 iron, the spin values of 7919, 8170 and 8252 of the three-layer cover balls (Inventive Examples 1–3, respectively) are also comparable to the spin values of 8339, 8262, 7994 and 8184 of the two-layer cover balls (Comparative Examples 2–5, respectively).

Using the full wedge, the spin values of 9151, 9266 and 9290 of the three-layer cover balls (Inventive Examples 1–3, respectively) are similar to the spin values of 9462, 9359, 9141 and 9321 of the two-layer cover balls (Comparative Examples 2–5).

Using the half wedge, the spin values of 6711, 6933 and 7038 of the three-layer cover balls (Inventive Examples 1–3, respectively) are also similar to the spin values of 7039, 7052, 6632, and 7015 of the two-layer cover balls (Comparative Examples 2–5, respectively).

TABLE VII

Comparison of Carry and Roll as the Total Distance

| Examples | Ball Type | No. of Cover Layers | Materials | Carry | Roll | Total Dist. |
|---|---|---|---|---|---|---|
| Comparative Example 1 | Pinnacle Gold Distance | 1 | Ionomeric | 240.3 | 4.7 | 245.0 |
| Comparative Example 2 | Ionomeric Casing/ 45D Urethane | 2 | Ionomeric Nonionomeric | 237.6 | 2.8 | 240.4 |
| Comparative Example 3 | Ionomeric Casing/ 45D Urethane | 2 | Ionomeric Nonionomeric | 237.1 | 3.8 | 241.0 |
| Comparative Example 4 | Nucrel 960/ 55D Urethane | 2 | Nonionomeric Nonionomeric | 230.0 | 5.1 | 235.2 |
| Comparative Example 5 | Surlyn 9120/ 45D Urethane | 2 | Ionomeric Nonionomeric | 237.7 | 3.5 | 241.2 |
| Comparative Example 6 | BIIM Ball Bridgestone, Japan | 3 | | 240.4 | 3.6 | 244.0 |
| Inventive Example 1 | Surlyn 9120/ Nucrel 960/ 55D Urethane | 3 | Ionomeric Nonionomeric Nonionomeric | 232.8 | 5.2 | 238.0 |
| Inventive Example 2 | Nucrel 960/ Surlyn 9120/ 45D Urethane | 3 | Nonionomeric Ionomeric Nonionomeric | 234.6 | 4.4 | 239.0 |
| Inventive Example 2 | Surlyn 9120/ Nucrel 960/ 45D Urethane | 3 | Ionomeric Nonionomeric Nonionomeric | 235.4 | 3.2 | 238.5 |

From Table VII, the total distances of 238.0, 239.0, and 238.5 of the three-layer cover balls (Inventive Examples 1–3, respectively) are very similar to the total distances of 240.4, 241.0, 235.2 and 241.2 of the two-layer cover balls (Comparative Examples 2–5, respectively).

Other than in the operating examples, or unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

What is claimed is:

1. A golf ball comprising:

a core; and a cover comprising:

an inner cover layer having a thickness of 0.010 to 0.100 inches and comprising a non-ionomeric composition comprised of an acid copolymer or terpolymer having a formula of E/X/Y, where E is an olefin, Y is a carboxylic acid, and X is a softening comonomer;

an outer cover layer comprising: a light-stable polyurea or a copolymer of a polyurea; and an intermediate cover layer disposed between the inner and outer cover layers comprising a fully-neutralized ionomer formed from a reaction between an ionomer having acid groups, a suitable cation source, and a salt of an organic acid, the cation source being present in an amount sufficient to neutralize the acid groups by at least 100%, wherein the organic acid is selected from the group consisting of caproic acid, caprylic acid, capric acid, lauric acid, stearic acid, behenic acid, erucic acid, oleic acid, and linoleic acid.

2. The golf ball of claim 1, wherein the polyurea and the copolymer of the polyurea are prepared from an isocyanate comprising 2,2'-, 2,4'-, and 4,4'-diphenylmethane diisocyanate, 3,3'-dimethyl-4,4'-biphenyl diisocyanate, toluene diisocyanate, polymeric diphenylmethane diisocyanates, carbodimide-modified liquid 4,4'-diphenylmethane diisocyanate, p-phenylene diisocyanate, m-phenylene diisocyanate, triphenylmethane-4,4'-triisocyanate, and triphenylmethane-4,4"-triisocyanate, napthylene-1,5,-diisocyanate, 2,4'-, 4,4'-, and 2,2-biphenyl diisocyanate, polyphenyl polymethylene polyisocyanate, ethylene diisocyanate, propylene- 1,2-diisocyanate, tetramethylene diisocyanate, tetramethylene- 1,4-diisocyanate, 1,6-hexamethylene-diisocyanate, octamethylene diisocyanate, decamethylene diisocyanate, 2,2,4-trimethylhexamethylene diisocyanate, 2,4,4-trimethylhexamethylene diisocyanate, dodecane-1,12-disocyanate, cyclobutane-1,3-diisocyanate, cyclohexane-1,2-diisocyanate, cyclohexane-1,3-diisocyanate, cyclohexane-1,4-diisocyanate, methyl-cyclohexylene diisocyanate, 2,4-methylcyclohexane diisocyanate, 2,6-methylcyclohexane diisocyanate, 4,4'-dicyclohexyl diisocyanate, 2,4'-dicyclohexyl diisocyanate, 1,3,5-cyclohexane triisocyanate, isocyanatomethylcyclohexane isocyanate, 1-isocyanato-3,3,5-trimethyl-5-isocyanatomethylcyclohexane, isocyanatoethylcyclohexane isocyanate, bis(isocyanatomethyl)-cyclohexane diisocyanate, 4,4'-bis(isocyanatomethyl) dicyclohexane, 2,4'-bis(isocyanatomethyl) dicyclohexane, isophorone diisocyanate, triisocyanate of hexamethylene-diisocyanate, triisocyanate of 2,2,4-trimethyl-1,6-hexane diisocyanate, 4,4'-dicyclohexylmethane diisocyanate, 2,4-hexahydrotoluene diisocyanate, 2,6-hexahydrotoluene diisocyanate, 1,2-, 1,3-, and 1,4-xylene diisocyanate, m-tetramethylxylene diisocyanate, p-tetramethylxylene diisocyanate, trimerized isocyanurate of toluene diisocyanate, trimer of diphenylmethane diisocyanate, trimer of tetramethyixylene diisocyanate, isocyanurate of hexamethylene diisocyanate, isocyanurate of isophorone diisocyanate, dimerized uretdione of toluene diisocyanate, or uretdione of hexamethylene diisocyanate.

3. The golf ball of claim 1, wherein the polyurea and the copolymer of the polyurea are prepared from a polyamine comprising 3,5-dimethylthio-2,4-toluenediamine; 3,5-diethyltoluene-2,4-diamine, 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2', 3,3'-tetrachloro diamino diphenylmethane; 4,4'-methylene-bis-(3-chloro-2,6-diethylaniline); trimethylene glycol di-p-aminobenzoate; or a mixture thereof.

4. The golf ball of claim 1, wherein the intermediate cover layer has a thickness of 0.005 to 0.050 inches.

5. The golf ball of claim 1, wherein the outer cover layer has a material hardness of less than 60 Shore D, and the inner cover layer has a material hardness of greater than 60 Shore D.

6. The golf ball of claim 1, wherein the olefin comprises ethylene, and the carboxylic acid comprises acrylic acid, methacrylic acid, crotonic acid, maleic acid, fumaric acid, or itaconic acid.

7. The golf ball of claim 1, wherein the cation source comprises barium, lithium, sodium, zinc, bismuth, chromium, cobalt, copper, potassium, strontium, titanium, tungsten, magnesium, cesium, iron, nickel, silver, aluminum, tin, or calcium.

8. The golf ball of claim 1, wherein the intermediate cover layer has a material hardness of 30 Shore D to 65 Shore D.

9. The golf ball of claim 1, wherein the organic acid is non-volatile and non-migratory.

10. The golf ball of claim 1, wherein the core comprises a fully neutralized ionomer being formed from a reaction between an ionomer having acid groups, a suitable cation source, and a salt of an organic acid, the cation source being present in an amount sufficient to neutralize the acid groups 100%.

11. A golf ball comprising:

a core; and a cover comprising:

an inner cover layer comprising a fully-neutralized ionomer formed from a reaction between an ionomer having acid groups, a suitable cation source, and a salt of an organic acid, the cation source being present in an amount sufficient to neutralize the acid groups by at least 100%, wherein the organic acid is selected from the group consisting of caproic acid, caprylic acid, capric acid, lauric acid, stearic acid, behenic acid, erucic acid, oleic acid, and linoleic acid;

an outer cover layer comprising a light-stable polyurea or a copolymer of a polyurea; and an intermediate cover layer disposed between the inner and outer cover layers comprising a non-ionomeric composition comprised of an acid copolymer or terpolymer having a formula of E/X/Y, where E is an olefin, Y is a carboxylic acid, and X is a softening comonomer.

12. The golf ball of claim 11, wherein the polyurea and the copolymer of the polyurea are prepared from an isocyanate comprising 2,2'-, 2,4'-, and 4,4'-diphenylmethane diisocyanate, 3,3'-dimethyl-4,4'-biphenyl diisocyanate, toluene diisocyanate, polymeric diphenylmethane diisocyanates, carbodimide-modified liquid 4,4'-diphenylmethane diisocyanate, p-phenylene diisocyanate, m-phenylene diisocyanate, triphenylmethane-4,4'-triisocyanate, and triphenylmethane-4,4"-triisocyanate, napthylene-1,5,-diisocyanate, 2,4'-, 4,4'-, and 2,2-biphenyl diisocyanate, polyphenyl polymethylene polyisocyanate, ethylene diisocyanate, propylene-1,2-diisocyanate, tetramethylene diisocyanate, tetramethylene-1,4-diisocyanate, 1,6-hexamethylene-diisocyanate, octamethylene diisocyanate, decamethylene diisocyanate, 2,2,4-trimethylhexamethylene diisocyanate, 2,4,4-trimethylhexamethylene diisocyanate, dodecane-1,12-diisocyanate, cyclobutane-1,3-diisocyanate, cyclohexane-1,2-diisocyanate, cyclohexane-1,3-diisocyanate, cyclohexane-1,4-diisocyanate, methyl-cyclohexylene diisocyanate, 2,4-methylcyclohexane diisocyanate, 2,6-methylcyclohexane diisocyanate, 4,4'-dicyclohexyl diisoeyanate, 2,4'-dicyclohexyl diisocyanate, 1,3,5-cyclohexane triisocyanate, isocyanatomethylcyclohexane isocyanate, 1-isocyanato-3,3,5-trimethyl-5-isocyanatomethylcyclohexane, isocyanatoethylcyclohexane isocyanate, bis(isocyanatomethyl)-cyclohexane diisocyanate, 4,4'-bis(isocyanatomethyl) dicyclohexane, 2,4'-bis(isocyanatomethyl) dicyclohexane, isophorone diisocyanate, triisocyanate of hexamethylene-diisocyanate, triisocyanate of 2,2,4-trimethyl- 1,6-hexane diisocyanate, 4,4'-dicyclohexylmethane diisocyanate, 2,4-hexahydrotoluene diisocyanate, 2,6-hexahydrotoluene diisocyanate, 1,2-, 1,3-, and 1,4-xylene diisocyanate, m-tetramethylxylene diisocyanate, p-tetramethylxylene diisocyanate, trimerized isocyanurate of toluene diisocyanate, trimer of diphenylmethane diisocyanate, timer of tetramethylxylene diisocyanate, isocyanurate of hexamethylene diisocyanate, isocyanurate of isophorone diisocyanate, dimerized uretdione of toluene diisocyanate, or uretdione of hexamethylene diisocyanate.

13. The golf ball of claim 11, wherein the polyurea and the copolymer of the polyurea are prepared from a polyamine comprising 3,5-dimethylthio-2,4-toluenediamine; 3,5-diethyltoluene-2,4-diamine, 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline; m-phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2', 3,3'-tetrachloro diamino diphenylmethane; 4,4'-methylene-bis-(3-chloro-2,6-diethylaniline); trimethylene glycol di-p-aminobenzoate; or a mixture thereof.

14. The golf ball of claim 11, wherein the intermediate cover layer has a thickness of 0.005 to 0.050 inches.

15. The golf ball of claim 11, wherein the outer cover layer has a material hardness of less than 60 Shore D, and the inner cover layer has a material hardness of greater than 60 Shore D.

16. The golf ball of claim 11, wherein the olefin comprises ethylene, and the carboxylic acid comprises acrylic acid, methacrylic acid, crotonic acid, maleic acid, fumaric acid, or itaconic acid.

17. The golf ball of claim 11, wherein the cation source comprises barium, lithium, sodium, zinc, bismuth, chromium, cobalt, copper, potassium, strontium, titanium, tungsten, magnesium, cesium, iron, nickel, silver, aluminum, tin, or calcium.

18. The golf ball of claim 11, wherein the intermediate cover layer has a material hardness of 30 Shore D to 65 Shore D.

19. The golf ball of claim 11, wherein the organic acid is non-volatile and non-migratory.

20. The golf ball of claim 11, wherein the core comprises a fully neutralized ionomer being formed from a reaction between an ionomer having acid groups, a suitable cation source, and a salt of an organic acid, the cation source being present in an amount sufficient to neutralize the acid groups 100%.

* * * * *